US007554267B2

(12) United States Patent
Hur et al.

(10) Patent No.: US 7,554,267 B2
(45) Date of Patent: Jun. 30, 2009

(54) PLASMA DISPLAY PANEL

(75) Inventors: Min Hur, Suwon-si (KR); Hoon-Young Choi, Suwon-si (KR); Young-Do Choi, Suwon-si (KR); Takahisa Mizuta, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 526 days.

(21) Appl. No.: 11/197,628

(22) Filed: Aug. 3, 2005

(65) Prior Publication Data

US 2006/0103304 A1 May 18, 2006

(30) Foreign Application Priority Data

Nov. 17, 2004 (KR) ..... 10-2004-0093919
Nov. 17, 2004 (KR) ..... 10-2004-0093920

(51) Int. Cl.
*H01J 17/49* (2006.01)

(52) U.S. Cl. ..... 313/582; 313/491; 445/24

(58) Field of Classification Search ..... 313/582–587; 315/169.1, 169.4; 345/37, 41, 60, 71, 76
See application file for complete search history.

(56) References Cited

U.S. PATENT DOCUMENTS 5,175,473 A 12/1992 Kim
5,384,514 A 1/1995 Kim
5,744,909 A * 4/1998 Amano ..... 313/585
5,939,826 A * 8/1999 Ohsawa et al. ..... 313/582
5,939,828 A * 8/1999 Matsuzaki et al. ..... 313/584
6,380,678 B1 * 4/2002 Kim ..... 313/586
6,577,061 B2 6/2003 Sano et al.
7,230,378 B2 * 6/2007 Su ..... 313/583
7,327,083 B2 2/2008 Woo et al.
2001/0050534 A1 * 12/2001 Amemiya et al. ..... 313/586

(Continued)

FOREIGN PATENT DOCUMENTS

DE 42 32 885 A1 4/1993

(Continued)

OTHER PUBLICATIONS

European Search Report for EP 05107084.5-2208 mailed Jan. 10, 2006.

(Continued)

*Primary Examiner*—Donald L. Raleigh
(74) *Attorney, Agent, or Firm*—Christie Parker & Hale LLP

(57) ABSTRACT

A PDP having an opposing electrode structure including first and second substrates facing each other. A space between the first and second substrates is divided into discharge cells. Address electrodes extend in a first direction between the first and second substrates, and first and second electrodes extend in a second direction intersecting the first direction while being spaced apart from the address electrodes. At least one of the address electrodes or the first and second electrodes has a protruding portion that protrudes toward the center of each discharge cell. The protruding portions help reduce the discharge gap which in turn reduces the discharge firing voltage. Expansion portions formed as parts of the first and second electrodes increase the discharge gap used by the sustain discharge and lead to an improved luminescence efficiency.

35 Claims, 37 Drawing Sheets

U.S. PATENT DOCUMENTS

| | | | | |
|---|---|---|---|---|
| 2002/0027418 | A1 | 3/2002 | Huang et al. | |
| 2002/0135542 | A1 | 9/2002 | Kim et al. | |
| 2002/0145387 | A1* | 10/2002 | Akiba | 313/586 |
| 2002/0180354 | A1 | 12/2002 | Sano et al. | |
| 2003/0034734 | A1 | 2/2003 | Kim et al. | |
| 2003/0146713 | A1* | 8/2003 | Nagao et al. | 315/169.4 |
| 2003/0155863 | A1 | 8/2003 | Lee | |
| 2004/0104868 | A1* | 6/2004 | Ajiki et al. | 345/60 |
| 2004/0135509 | A1 | 7/2004 | Kwon et al. | |
| 2004/0245929 | A1* | 12/2004 | Sakamoto | 313/584 |
| 2004/0251831 | A1* | 12/2004 | Sung et al. | 313/582 |
| 2005/0029939 | A1* | 2/2005 | Woo et al. | 313/582 |
| 2005/0057443 | A1 | 3/2005 | Whang et al. | |
| 2005/0110409 | A1* | 5/2005 | Zeng et al. | 313/582 |
| 2006/0043891 | A1* | 3/2006 | Tessier et al. | 313/581 |
| 2006/0114179 | A1 | 6/2006 | Hur et al. | |
| 2006/0158113 | A1 | 7/2006 | Hur et al. | |

FOREIGN PATENT DOCUMENTS

| | | | |
|---|---|---|---|
| EP | 1 146 539 | A2 | 10/2001 |
| EP | 1 460 669 | A1 | 9/2004 |
| JP | 02-284333 | | 11/1990 |
| JP | 03-155024 | | 7/1991 |
| JP | 05-225912 | | 9/1993 |
| JP | 7-037511 | | 2/1995 |
| JP | 07-111135 | | 4/1995 |
| JP | 07-320644 | | 12/1995 |
| JP | 9-129138 | | 5/1997 |
| JP | 9-259768 | | 10/1997 |
| JP | 11-213903 | | 8/1999 |
| JP | 2000-149772 | | 5/2000 |
| JP | 2000-215813 | | 8/2000 |
| JP | 2000-331615 | | 11/2000 |
| JP | 2001-222959 | | 8/2001 |
| JP | 2001-307639 | | 11/2001 |
| JP | 2002-203484 | | 7/2002 |
| JP | 2003-059411 | | 2/2003 |
| JP | 2003-151449 | | 5/2003 |
| JP | 2003-197106 | | 7/2003 |
| JP | 2003-257321 | | 9/2003 |
| JP | 2003-338246 | | 11/2003 |
| JP | 2003-346665 | | 12/2003 |
| JP | 2004-235042 | | 8/2004 |
| JP | 2004-241379 | | 8/2004 |
| JP | 2004-247211 | | 9/2004 |
| JP | 2004-273328 | | 9/2004 |
| KR | 10-2001-0026193 | | 4/2001 |
| KR | 2002-029491 | | 4/2002 |
| KR | 10-2004-0097121 | | 11/2004 |
| KR | 10-2004-0108073 | | 12/2004 |
| KR | 10-2005-0112312 | | 11/2005 |
| KR | 10-0578936 | | 5/2006 |
| WO | WO 03/032356 | * | 4/2003 |
| WO | WO 03/060864 | A1 | 7/2003 |

OTHER PUBLICATIONS

European Search Report, dated Apr. 21, 2006, for EP Application No. 05111198.7.

Patent Abstracts of Japan, Publication No. 02-284333, dated Nov. 21, 1990, in the name of Naoatsu Higuchi.

Patent Abstracts of Japan, Publication No. 03-155024, dated Jul. 3, 1991, in the name of Motoo Sugawara.

Patent Abstracts of Japan, Publication No. 07-037511, dated Feb. 7, 1995, in the name of Tetsuyoshi Tomioka et al.

Patent Abstracts of Japan, Publication No. 07-320644, dated Dec. 8, 1995, in the name of Taichi Shino et al.

Patent Abstracts of Japan, Publication No. 09-129138, dated May 16, 1997, in the name of Masaomi Ebe.

Patent Abstracts of Japan, Publication No. 09-259768, dated Oct. 3, 1997, in the name of Hiroyuki Nakahara et al.

Patent Abstracts of Japan, Publication No. 11-213903, dated Aug. 6, 1999, in the name of Takashi Miyama et al.

Patent Abstracts of Japan, Publication No. 2000-149772, dated May 30, 2000, in the name of Yoshinobu Hirokado et al.

Patent Abstract of Japan for Publication No. 2000-331615; Date of publication of application Nov. 30, 2000, in the name of Hirakawa Hitoshi et al.

Patent Abstract of Japan for Publication No. 2003-151449; Date of publication of application May 23, 2003 in the name of Inoue Kazunori et al.

Patent Abstracts of Japan, Publication No. 2003-197106, dated Jul. 11, 2003, in the name of Susumu Sakamoto.

Patent Abstracts of Japan, Publication No. 2003-257321, dated Sep. 12, 2003, in the name of Hirokazu Hashikawa.

Patent Abstracts of Japan, Publication No. 2003-338246, dated Nov. 28, 2003, in the name of Yoshio Suzuki et al.

Patent Abstracts of Japan, Publication No. 2003-346665, dated Dec. 5, 2003, in the name of Masaki Aoki et al.

Patent Abstracts of Japan, Publication No. 2004-235042, dated Aug. 19, 2004, in the name of Susumu Sakamoto et al.

Patent Abstracts of Japan, Publication No. 2004-241379, dated Aug. 26, 2004, in the name of Kazuki Shigeta et al.

Patent Abstracts of Japan, Publication No. 2004-247211, dated Sep. 2, 2004, in the name of Shinsuke Mori et al.

Patent Abstracts of Japan, Publication No. 2004-273328, dated Sep. 30, 2004, in the name of Shinsuke Mori.

Korean Patent Abstracts, Publication No. 1020010026193 A, dated Apr. 6, 2001, in the name of Jin Won Hong.

Korean Patent Abstracts, Publication No. 1020040108073 A, dated Dec. 23, 2004, in the name of Yeong Jun Ahn et al.

Korean Patent Abstracts, Publication No. 1020050112312 A, dated Nov. 30, 2005, in the name of Tae Kyoung Kang et al.

U.S. Office action dated Jan. 22, 2009, for related U.S. Appl. No. 11/282,249, indicating relevance of listed U.S. and Korean references in this IDS.

Patent Abstracts of Japan, Publication No. 07-111135, dated Apr. 25, 1995, in the name of Ichiro Koiwa et al.

Patent Abstracts of Japan, Publication No. 2000-215813, dated Aug. 4, 2000, in the name of Shinichiro Nagano.

Patent Abstracts of Japan, Publication No. 2001-222959, Aug. 17, 2001, in the name of Takashi Furuya.

Patent Abstracts of Japan, Publication No. 2001-307639, dated Nov. 2, 2001, in the name of Akira Shiokawa et al.

Patent Abstracts of Japan, Publication No. 2002-203484, dated Jul. 19, 2002, in the name of Shinichiro Shiromizu.

Patent Abstracts of Japan, Publication No. 2003-059411, dated Feb. 28, 2003, in the name of Hironobu Abe.

Machine translation of Korean Publication 10-2002-0029491, dated Apr. 19, 2002, in the name of Je-Seok Jeong.

* cited by examiner

PLASMA DISPLAY PANEL

CROSS REFERENCES TO RELATED APPLICATIONS

This application claims priority to and the benefit of Korean Patent Applications No. 10-2004-0093919 and No. 10-2004-0093920 filed in the Korean Intellectual Property Office both on the same day of Nov. 17, 2004, the entire contents of which are incorporated herein by reference.

FIELD OF THE INVENTION

The present invention relates to a plasma display panel, and more particularly, to a plasma display panel that can reduce a discharge firing voltage and improve luminescence efficiency.

BACKGROUND OF THE INVENTION

Generally, a plasma display panel (PDP) has a three-electrode surface-discharge structure. The PDP having the three-electrode surface-discharge structure includes front and rear substrates. A discharge gas is sealed between the two substrates.

The front substrate has sustain electrodes and scan electrodes that extend in one direction on the inner surface of the front substrate. The rear substrate is spaced apart from the inner surface of the front substrate and has address electrodes that extend in a direction intersecting the direction of the sustain and scan electrodes.

In this PDP, whether or not a discharge is generated is determined by an address discharge between the sustain electrodes and the address electrodes that are controlled independently. Then, images are realized by a sustain discharge between the sustain electrodes and the scan electrodes located on the inner surface of the front substrate.

The PDP generates visible light by using a glow discharge. After the glow discharge is generated, visible light reaches human eyes through several steps. If the glow discharge is generated, gas is excited by the collision of electrons against gas and then vacuum ultraviolet rays are generated from the excited gas. The vacuum ultraviolet rays collide against phosphors in discharge cells. As a result, visible light is generated and reaches the human eye through the transparent front substrate.

While passing through the above steps, input energy applied to a cathode and an anode is lost due to inefficiencies. To compensate for the lost energy, the glow discharge is generated by applying a voltage higher than a discharge firing voltage between the two electrodes. In order to fire the glow discharge, a considerably high voltage is required.

Once discharge is generated, the voltage distribution between the cathode and the anode is distorted due to a space charge effect caused by dielectric layers in the periphery of the cathode and the anode. A cathode sheath region, an anode sheath region, and a positive column region are formed between the two electrodes.

The cathode sheath region is a region in the periphery of the cathode, in which most of the voltage applied between the two electrodes is consumed. The anode sheath region is a region in the periphery of the anode, in which some of the voltage is consumed. The positive column region is a region between the cathode sheath region and the anode sheath region, in which almost no voltage is consumed.

The electron heating efficiency of the cathode sheath region depends on the secondary electrode coefficient of an MgO protective film that is formed on the surface of the dielectric layer. In the positive column region, most of the input energy is consumed for electron heating.

The vacuum ultraviolet rays are generated when xenon (Xe) gas is changed from an excitation state to a ground state. The excitation state of Xe gas is generated by the collision between Xe gas and electrons.

In order to increase the luminescence efficiency, which is the ratio of visible light to the input energy, the rate of collision between Xe gas and electrons must be increased. In order to increase the rate of this collision, the electron heating efficiency must be increased.

Most of the input energy is consumed in the cathode sheath region. In the positive column region, consumption of the input energy is low and the electron heating efficiency is high. Accordingly, a higher luminescence efficiency can be obtained by a larger positive column region. The positive column region is also called a discharge gap.

The change in the E/n, the ratio of the electric field E across the discharge gap to the gas density n, and the ratio of electron consumption to the overall number of electrons have been studied. At the same electric field to gas density ratio, E/n, the ratio of electron consumption to the total number of electrons is increased with an increase in xenon excitation Xe*, xenon ions $Xe^+$, neon excitation Ne*, and neon ions $Ne^+$.

Further, it has been known that, at the same ratio E/n, the higher the partial pressure of Xe, the lower the electron energy. That is, if the electron energy is decreased, the partial pressure of Xe is increased. As a result, the ratio of electron consumption for the excitation of Xe* is higher than electron consumption for xenon ions $Xe^+$, neon excitation Ne*, or neon ions $Ne^+$. Accordingly, the luminescence efficiency is enhanced in the case of Xe* excitation.

As described above, an increase in the positive column region results in an increase in the electron heating efficiency. Further, increase in the partial pressure of Xe results in the increase of the electron heating efficiency of electrons consumed for the excitation of Xe. Accordingly, an increase in the positive column region and an increase in the partial pressure of Xe, both result in the increase of the electron heating efficiency, thereby enhancing the luminescence efficiency.

However, increase in the positive column region or increase in the partial pressure of Xe, result in an increased discharge firing voltage, which causes the manufacturing cost of the PDP to be increased. Therefore, an increase in the positive column region or the partial pressure of Xe must be achieved under low discharge firing voltage, in order to enhance the luminescence efficiency. For the same discharge gap and partial pressure of Xe, the discharge firing voltage required for the opposing electrode structure is lower than the discharge firing voltage required for the surface discharge structure.

SUMMARY OF THE INVENTION

One embodiment of the present invention provides a PDP with an opposing electrode structure which has reduced discharge firing voltage and enhanced luminescence efficiency.

According to an aspect of the invention, a PDP is presented that includes first and second substrates that face each other with a distance in between. The space between the first and second substrates is divided into a plurality of discharge cells. Address electrodes extend in a first direction between the first and second substrates. First electrodes and second electrodes extend in a second direction intersecting the first direction while being spaced apart from the address electrodes. The first electrodes and the second electrodes extend toward the second substrate and face each other with a space therebetween. At least one of the first and second electrodes has a protruding portion that protrudes toward the center of each discharge cell.

The PDP of the present invention may further include a first barrier rib layer that divides the space near the first substrate into a plurality of discharge spaces and a second barrier rib layer that divides the space near the second substrate into discharge cells that correspond to the discharge spaces on the first substrate. Each discharge cell may be formed by a pair of discharge spaces facing each other.

The address electrodes, the first electrodes, and the second electrodes may be located between the first barrier rib layer and the second barrier rib layer.

The discharge spaces formed by the second barrier rib layer may have larger volumes than the discharge spaces formed by the first barrier rib layer.

The first barrier rib layer may have first barrier rib members that extend in the first direction, and the second barrier rib layer may have second barrier rib members that also extend in the first direction.

The first barrier rib layer may have second barrier rib members that intersect the first barrier rib members, and the second barrier rib layer may have fourth barrier rib members that intersect the third barrier rib members.

The address electrodes may extend along the first barrier rib members between the first barrier rib members of the first barrier rib layer and the third barrier rib members of the second barrier rib layer.

The address electrodes may pass through the boundary of a pair of adjacent discharge cells.

Each of the first and second electrodes may have an expansion portion that extends in a direction perpendicular to the surface of the first substrate from a portion corresponding to each discharge cell and a narrow portion that is formed at a portion corresponding to the boundary of a pair of adjacent discharge cells.

The protruding portion may protrude from the expansion portion. In one embodiment, the protruding portion protrude in a hexahedron shape.

In one embodiment, the first and second electrodes are made of metal electrodes having superior conductivity.

In one embodiment, the first electrodes, the second electrodes, and the address electrodes have insulating structures made from dielectric layers provided on outer surfaces of these electrodes.

In one embodiment, the dielectric layers have a protective film on their outer surfaces.

In one embodiment, the protruding portion of each of the second electrodes is inclined toward the address electrode provided on one side of each discharge cell.

In one embodiment, in the discharge cell, the distance between the protruding portion of each of the second electrodes and the address electrodes provided on one side of each discharge cell is shorter than the distance between the protruding portion and the address electrode provided on the other side of each discharge cell.

At least a portion of each of the first and second electrodes may be formed on the same plane as the address electrodes.

The distance between the address electrode and the surface of the first substrate may be the same as the distance between the first electrode and the surface of the first substrate and the distance between the protruding portion of the second electrode and the surface of the first substrate.

The thickness of the address electrode in a vertical direction of the substrate may be larger than the thickness of the protruding portion of the first electrode in the vertical direction of the substrate and the thickness of the protruding portion of the second electrode in the vertical direction of the substrate.

A phosphor layer that is to be formed in each discharge cell may include a first phosphor layer that is formed in each discharge cell on the first substrate and a second phosphor layer that is formed in each discharge cell on the second substrate and may be made of a phosphor that generates visible light of the same color as that of the first phosphor layer.

In one embodiment, the thickness of the first phosphor layer is formed to be larger than the thickness of the second phosphor layer.

The PDP of the invention may further include black layers, near the second substrate, that have shapes corresponding to planar patterns of the address electrodes, the first electrodes, and the second electrodes.

In the discharge cells located along the first direction, the first and second electrodes may be located in pairs. A sustain pulse is applied to the first electrode during a sustain discharge period. The sustain pulse is applied also to the second electrode, during the sustain discharge period. A scan pulse is applied to the second electrode during an address period.

The first and second electrodes corresponding to a pair of adjacent discharge cells may be located in the same order or in an opposite order.

Each of the address electrodes may have a protruding portion that protrudes to the center of each discharge cell.

The protruding portion of each of the address electrodes may be formed on the same plane as the protruding portion of each of the first electrodes or the protruding portion of each of the second electrodes.

Another embodiment may include a first substrate, a second substrate spaced apart from the first substrate, a plurality of partitioned discharge cells being formed between the first substrate and the second substrate, the discharge cells having a first substrate discharge space on the first substrate and a second substrate discharge space on the second substrate, address electrodes extending along a first direction between the first substrate and the second substrate and parallel to them, first electrodes and second electrodes extending along a second direction between and parallel to the first substrate and the second substrate, the second direction crossing the first direction, the first electrodes and the second electrodes being separated from the address electrodes, and protruding portions formed on at least one of the first and second electrodes, the protruding portions protruding toward centers of each discharge cell, where the address electrodes, the first electrodes, and the second electrodes are located between the first substrate discharge space and the second substrate discharge space.

DETAILED DESCRIPTION

Figure 1:
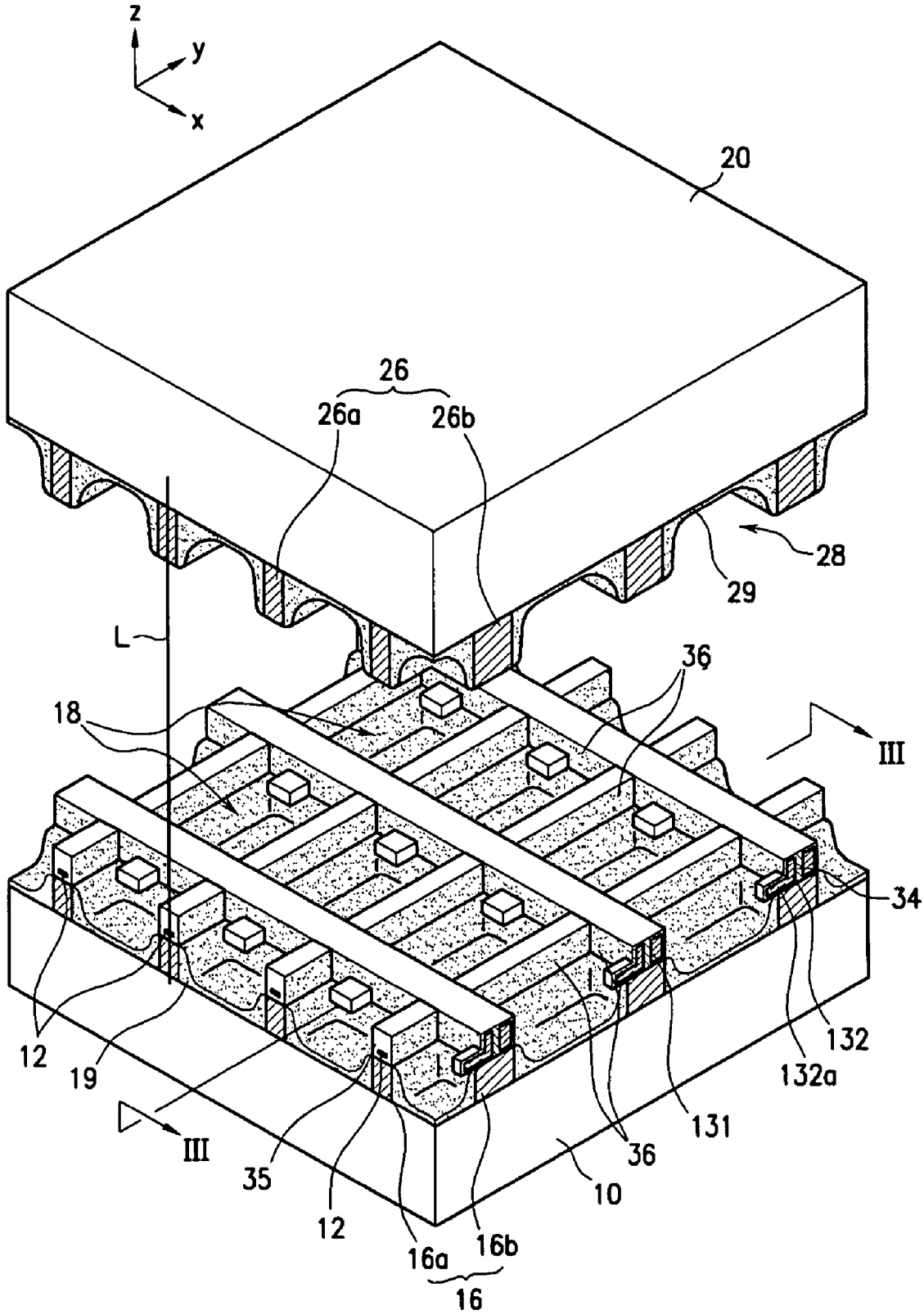
FIG. 1 is a partial exploded perspective view of a PDP according to a first embodiment of the present invention.
Figure 2:
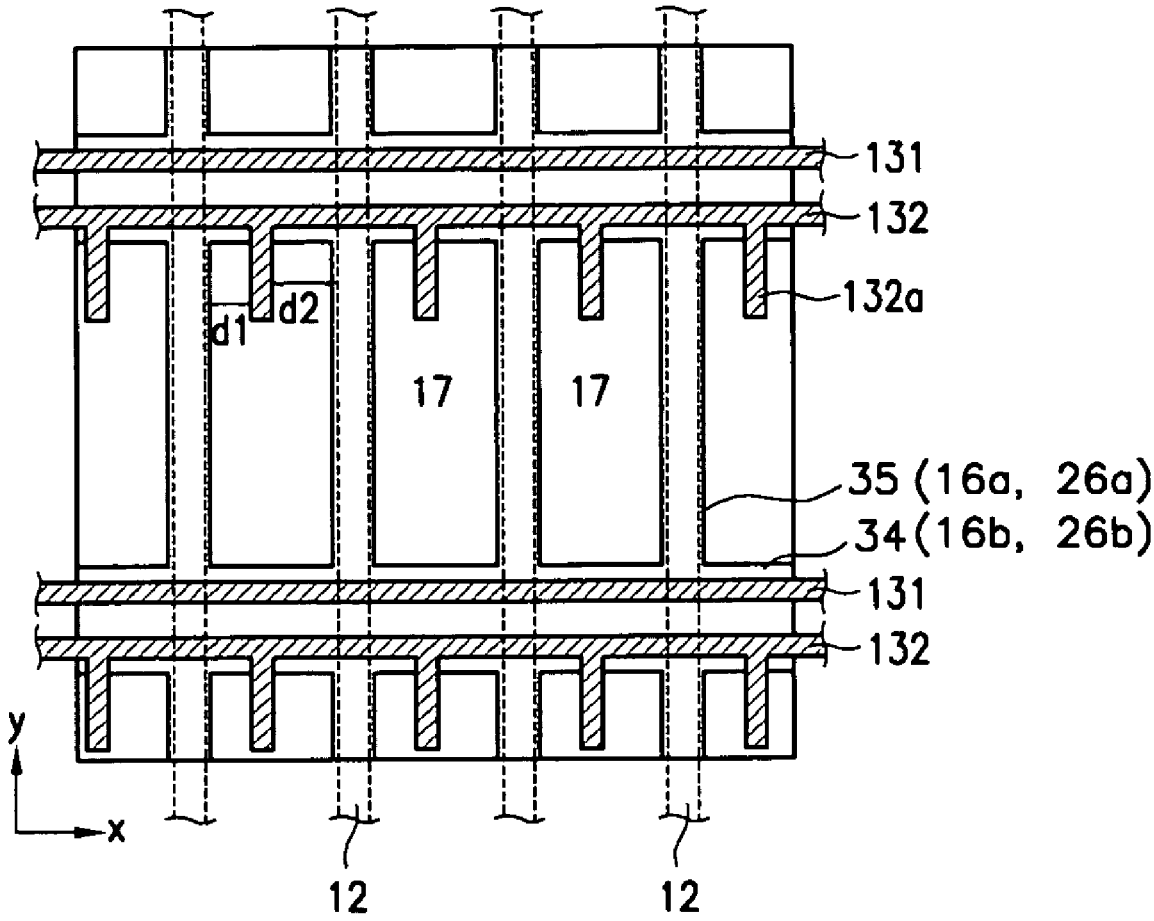
FIG. 2 is a plan view of electrodes and discharge cells in the PDP of the first embodiment of the present invention.
Figure 3:
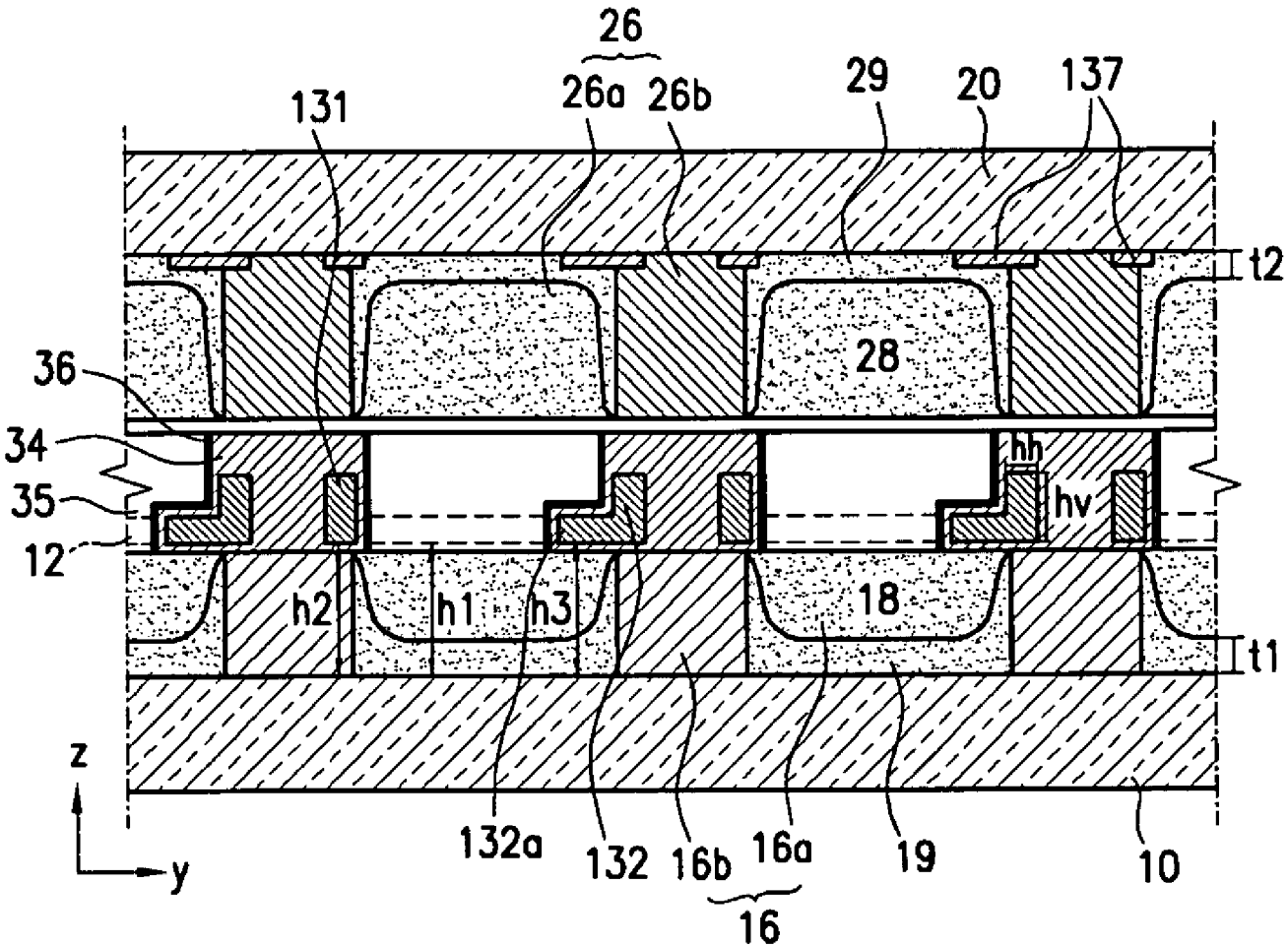
FIG. 3 is a cross-sectional view taken along the line III-III of FIG. 1.

Referring to FIGS. 1, 2, and 3, the PDP of the present invention includes a first substrate 10 (hereinafter, referred to as "rear substrate") and a second substrate 20 (hereinafter, referred to as "front substrate") that face each other and are separated by a predetermined distance. The PDP also includes a first barrier rib layer 16 and a second barrier rib layer 26 that are located between the rear substrate 10 and the front substrate 20 to form a back discharge space 18 and a front discharge space 28. The back discharge space 18 and the front discharge space 28, together form a discharge cell 17.

The first barrier rib layer 16 and the second barrier rib 26 partition a space between the rear and front substrates 10, 20 into discharge cells 17. In the discharge cells 17, phosphor layers 19, 29 are formed so as to absorb vacuum ultraviolet rays and to emit visible light. Further, a discharge gas (for example, a mixed gas including xenon (Xe), neon (Ne), or the like) is filled into the discharge cells 17 so as to generate the vacuum ultraviolet rays by a plasma discharge.

The first barrier rib layer 16 (hereinafter, referred to as "rear-plate barrier rib") and the second barrier rib layer 26 (hereinafter, referred to as "front-plate barrier rib") are located between the rear substrate 10 and the front substrate 20.

The rear-plate barrier rib 16 protrudes from the rear substrate 10 toward the front substrate 20. The front-plate barrier rib 26 protrudes from the front substrate 20 toward the rear substrate 10.

The rear-plate barrier rib 16 partitions the space near the rear substrate 10 to form the back discharge spaces 18 on the rear substrate 10. The front-plate barrier rib 26 partitions the space near the front substrate 20 to form the front discharge spaces 28 on the front substrate 20. The back discharge space 18 and the front discharge space 28 facing each other form one discharge cell 17.

The discharge spaces 28 formed by the front-plate barrier rib 26 on the front substrate 20 may have a larger volume than the discharge spaces 18 formed by the rear-plate barrier rib 16 on the rear substrate 10. Then, transmittance of visible light generated in the discharge cells 17 passing through the front substrate 20 can be enhanced.

The rear-plate barrier rib 16 and the front-plate barrier rib 26 can be formed to have various shapes, such as rectangular or hexagonal shapes. In the embodiment shown, the discharge cells 17 having rectangular shapes are presented as an example.

The rear-plate barrier rib 16 is formed on the rear substrate 10 and includes first barrier rib members 16*a* and third barrier rib members 16*b*. The first barrier rib members 16*b* extend in one direction (y-axis direction of FIG. 1). The third barrier rib members 16*b* extend in a direction (x-axis direction of FIG. 1)

intersecting the first direction. The first and third barrier rib members 16*a*, 16*b*, themselves, also intersect. Accordingly, the first barrier rib members 16*a* and the third barrier rib members 16*b* form the discharge spaces 18 on the rear substrate 10.

The front-plate barrier rib 26 is formed on the front substrate 20 and includes second barrier rib members 26*a* and fourth barrier rib members 26*b*. The second barrier rib members 26*a* protrude toward the rear substrate 10 corresponding to the first barrier rib members 16*a*. The fourth barrier rib members 26*b* protrude toward the rear substrate 10 corresponding to the third barrier rib members 16*b*.

Accordingly, the second barrier rib members 26*a* and the fourth barrier rib members 26*b* extend in intersecting directions and form the front discharge spaces 28 on the front substrate 20. The front discharge spaces 28 correspond to the back discharge spaces 18 on the rear substrate 10.

The phosphor layers 19, 29 are formed in the back discharge spaces 18, and the front discharge spaces 28 that are partitioned by the rear-plate barrier rib 16 and the front-plate barrier rib 26. The phosphor layers 19, 29 include a first phosphor layer 19 that is formed in the back discharge spaces 18 on the rear substrate 10 and a second phosphor layer 29 that is formed in the front discharge spaces 28 on the front substrate 20 facing the back discharge space 18. The first phosphor layer 19 and the second phosphor layer 29 generate visible light from both sides of each discharge cell 17 and cause improved luminescence efficiency.

The back discharge space 18 and the front discharge space 28 facing the back discharge space 18 form one discharge cell 17. In one embodiment the first and second phosphor layers 19, 29 formed in the back and front parts of the discharge cells 17, are made of a phosphor that emit visible light of the same color.

The first phosphor layer 19 is formed on the inner surfaces of the first barrier rib member 16*a* and the third barrier rib member 16*b* constituting the inside of the back discharge space 18 and the surface of the rear substrate 10 in the back discharge space 18.

The second phosphor layer 29 is formed on the inner surfaces of the second barrier rib member 26*a* and the fourth barrier rib member 26*b* and the surface of the front substrate 20 in the front discharge space 28.

In an alternative embodiment, first a dielectric layer (not shown) is formed on the surface of the rear substrate 10 and then the rear-plate barrier rib 16 is formed. The first phosphor layer 19 may be formed by coating the phosphor on the surface of the dielectric layer.

In another alternative embodiment, after the rear-plate barrier rib 16 is formed on the surface of the rear substrate 10, the first phosphor layer 19 may be formed by coating the phosphor the surface of the rear substrate 10, without forming the dielectric layer on the rear substrate 10.

Similarly, after a dielectric layer (not shown) is formed on the surface of the front substrate 20 and then the front-plate barrier rib 26 is formed, the second phosphor layer 29 may be formed by coating the phosphor on the surface of the dielectric layer.

Alternatively, after the front-plate barrier rib 26 is formed on the surface of the front substrate 20, the second phosphor layer 29 may be formed by coating the phosphor on the surface of the front substrate 20, without forming the dielectric layer on the front substrate 20.

The discharge cells 17 may be formed on the rear and front substrates 10, 20 by etching the rear and front substrates 10, 20. Then, the first and second phosphor layers 19, 29 may be formed by coating the phosphors on the surfaces of the discharge cells 17, respectively. In this case, the rear-plate barrier rib 16 and the rear substrate 10 are made of the same material, and the front-plate barrier rib 26 and the front substrate 20 are made of the same material.

After a sustain discharge, the first phosphor layer 19 absorbs the vacuum ultraviolet rays in the back discharge space 18 and generates visible light toward the front substrate 20. The second phosphor layer 29 absorbs the vacuum ultraviolet rays in the front discharge space 28 and generates visible light toward the front substrate 20.

The thickness t1 of the first phosphor layer 19 formed on the rear substrate 10 is, in one embodiment, larger than the thickness t2 of the second phosphor layer 29 formed on the front substrate 20 (t1>t2). Because visible light must pass through the second phosphor layer 29, in order to facilitate the transmission of light, the thickness of this layer t1 is smaller than the thickness of the first phosphor layer 19. This design minimizes the loss of the vacuum ultraviolet rays and increases the luminescence efficiency.

The vacuum ultraviolet rays that collide against the first and second phosphor layers 19, 29 are generated by the plasma discharge. To generate plasma discharge, address electrodes 12, first electrodes 131 (hereinafter, referred to as "sustain electrodes"), and second electrodes 132 (hereinafter, referred to as "scan electrodes") are provided between the rear substrate 10 and the front substrate 20 corresponding to the discharge cells 17 where the plasma discharge is to occur.

The address electrodes 12 extend along a first direction (y-axis direction of FIG. 1 and FIG. 2) between the rear-plate barrier ribs 16 and the front-plate barrier ribs 26. In the embodiment shown, the address electrodes 12 extend along the direction of the first barrier rib members 16*a* (y-axis direction) and parallel to these members. Further, the plurality of address electrodes 12 are in parallel with one another while maintaining intervals corresponding to the back discharge spaces 18 (the intervals shown along an x-axis direction of FIGS. 1 and 2).

Each address electrode 12 is shared by a pair of adjacent discharge cells 17 that are formed along a direction (x-axis direction) intersecting the direction of the address electrode 12. One discharge cell 17 and another adjacent discharge cell 17 form the pair of adjacent discharge cells 17, 17 that share the address electrode 12. Hereinafter, for convenience, "adjacent discharge cells" or "a pair of discharge cells" are simply represented by "17". The address electrode 12 corresponds to the center of the first barrier rib member 16*a* and thus overlaps adjacent back discharge spaces 18,18 along the x-axis direction.

The address electrode 12 is located between the first barrier rib member 16*a* provided on the rear substrate 10 and the second barrier rib member 26*a* provided on the front substrate 20. Further, with reference to a vertical cross-section of the front substrate 20 and the rear substrate 10 (x-z cross-section), the center line of the address electrode 12 and the center line of the first or second barrier rib members 16*a*, 26*a* in a longitudinal direction (y-axis direction) may be connected by an imaginary straight line L shown in FIG. 1.

On the other hand, the sustain electrodes 131 and the scan electrodes 132 are located between the rear-plate barrier ribs 16 and the front-plate barrier ribs 26 bordering the discharge cells 17. Further, the sustain electrodes 131 and the scan electrodes 132 are electrically isolated from the address electrodes 12 and extend along a second direction (x-axis direction) intersecting the direction of the address electrodes 12.

The sustain electrodes 131 and the scan electrodes 132 extend between the third barrier rib members 16*b* and the fourth barrier rib members 26*b* in a direction parallel to these members. Pairs of the sustain and scan electrodes 131, 132 are located on two sides of the discharge cells 17 (see FIG. 3).

The sustain electrodes 131 and the scan electrode 132 are alternately located between the third barrier rib members 16*b* and the fourth barrier rib members 26*b*. Accordingly, the sustain electrodes 131 and the scan electrodes 132 function as a reference for dividing adjacent discharge cells 17 across a longitudinal direction of the address electrodes 12 (y-axis direction).

The scan electrodes 132 that are involved in the address discharge of the address period, together with the address electrodes 12, select the discharge cells 17 to be turned on. The sustain electrodes 131 and the scan electrodes 132 are involved in the sustain discharge of the sustain discharge period and display the images.

Figure 37:
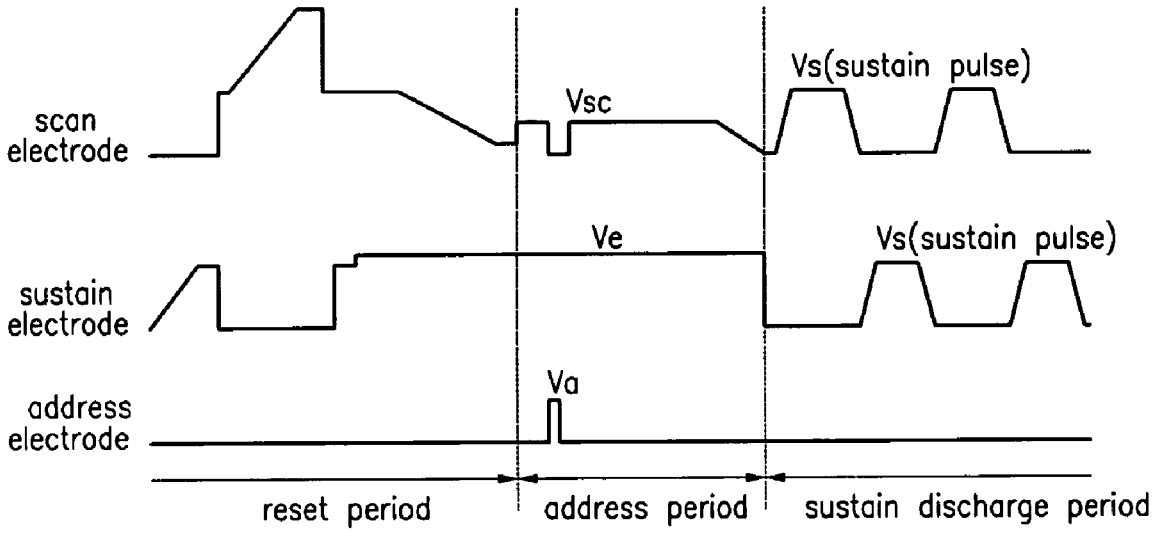
FIG. 37 illustrates driving signals of a PDP according to a first embodiment of the present invention.

Referring to FIG. 37, sustain pulses Vs are applied to the sustain electrodes 131 during the sustain discharge period. Sustain pulses Vs are applied to the scan electrodes 132 during the sustain discharge period. Scan pulses Vsc are applied to the scan electrodes 132 during the address period. Address pulses Va are applied to the address electrodes 12 during the address period. However, the present invention is not limited to electrodes that have the above-described functions. For example, these electrodes may perform other functions depending on signal voltages applied to them.

The sustain electrodes 131 and the scan electrodes 132 are provided between the rear and front substrates 10, 20 to partition the space between the two substrates into the discharge cells 17 forming the opposing electrode structure of the PDP. The opposing electrode structure has a reduced discharge firing voltage, as compared to the surface discharge structure.

In addition, the scan electrodes 132 have protruding portions 132*a* that protrude toward the centers of the discharge cells 17. The protruding portions 132*a* shorten the discharge gaps between the sustain electrodes 131 and the scan electrodes 132 in the discharge cells 17. Accordingly, during the sustain discharge, an initial discharge firing voltage may be reduced.

Further, during address discharge with the address electrodes 12, the protruding portions 132*a* limit the discharge to the peripheries of the protruding portions 132*a*, and thus production of unnecessary light during the address discharge is reduced. Light emission during the address discharge period has a deleterious effect upon image display.

Figure 4:
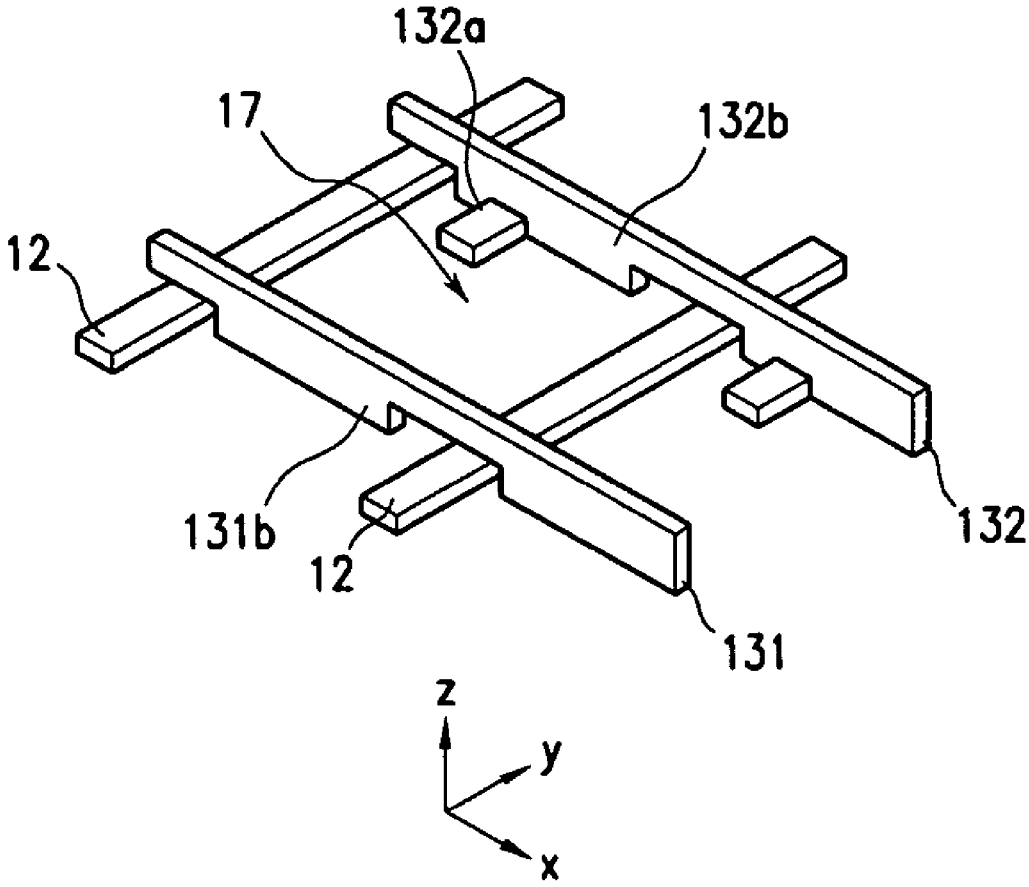
FIG. 4 is a perspective view of the electrodes in the PDP of the first embodiment of the present invention.

Further, in order to induce the opposing electrode discharge over a wider area, the sustain electrodes 131 and the scan electrodes 132 have expansion portions 131*b*, 132*b* in the discharge cells 17. The expansion portions 131*b*, 132*b* are shown in FIG. 4 that is a perspective view of the electrodes in the PDP of the first embodiment of the present invention. The expansion portions 131*b*, 132*b* extend in the z-axis direction of FIG. 4 which is a direction perpendicular to the rear substrate 10.

Referring to the x-z cross-section of the expansion portions 131*b*, 132*b*, shown in FIG. 3, indicates that a length hv in the vertical direction is longer than a length hh in the horizontal direction.

The opposing electrode discharge is generated over a larger area by using the expansion portions 131*b*, 132*b* and therefore generates more intense vacuum ultraviolet rays. The intense vacuum ultraviolet rays generated, collide against the first and second phosphor layers 19, 29 inside the discharge cells 17, increasing the resultant amount of visible light.

The protruding portions 132*a* are located such that the voltage applied to the scan electrodes 132 is applied to the centers of the discharge cells 17. Thus, the protruding portions 132*a*, in one embodiment, protrude from the expansion portions 132*b*.

The protruding portions 132*a* may be formed in various shapes and may protrude in hexahedron shapes or tetrahedron shapes (see FIG. 4). Hexahedron-shaped protruding portions 132*a* facilitate the induction of the opposing electrode discharge with the sustain electrodes 131 via front the ends of the protruding portions 132*a*. Further, the protruding portions 132*a* of the scan electrodes 132 facilitate the induction of the opposing electrode discharge with the address electrodes 12 during address discharge.

The sustain electrodes 131 and the scan electrodes 132 extend in a direction intersecting the direction of the address electrodes 12 and have the expansion portions 131*b*, 132*b* that are formed in a direction perpendicular to the rear and front substrates 10, 20. The sustain electrodes 131 and the scan electrodes 132 can be alternately located, without actually intersecting the address electrodes 12 (see FIG. 4).

Further, a distance h1 between the address electrode 12 and the rear substrate 10 is the same as a distance h2 between the sustain electrode 131 and the rear substrate 10 and a distance h3 between the protruding portion 132*a* of the scan electrode 132 and the rear substrate 10.

With equal distances h1, h2, and h3, the address discharge between the address electrodes 12 and the protruding portions 132*a* of the scan electrodes 132 is induced as an opposing electrode discharge and the sustain discharge between the sustain electrodes 131 and the protruding portions 132*a* of the scan electrodes 132 is induced as an opposing electrode discharge.

The sustain electrodes 131 and the protruding portions 132*a* of the scan electrodes 132 form short gaps to induce a low-voltage sustain discharge. The expansion portions 131*b* of the sustain electrodes 131 and the expansion portions 132*b* of the scan electrodes 132 form long gaps to create a full-scale sustain discharge. Accordingly, during the sustain discharge, while the discharge firing voltage is reduced, the luminescence efficiency is increased.

The sustain electrodes 131, the scan electrodes 132, and the address electrodes 12 may be made of metal that has superior conductivity. The sustain, scan, and address electrodes 131, 132, 12 are located in non-discharge regions of the rear-plate barrier rib 16 and the front-plate barrier rib 26 and do not shield visible light passing through the front substrate 20. Therefore, the sustain, scan, and address electrodes 131, 132, 12 may be made of nontransparent materials.

The sustain electrodes 131, the scan electrodes 132, and the address electrodes 12 have dielectric layers 34, 35 on their outer surfaces (see FIG. 3). The dielectric layers 34, 35 accumulate wall charges and form insulating structures for their respective electrodes.

The dielectric layers 34, 35 and the sustain electrodes 131, the scan electrodes 132, and the address electrodes 12 buried inside these dielectric layers, can be fabricated by a thick film ceramic sheet (TFCS) method. In this method, the sustain electrodes 131, the scan electrodes 132, and the address electrodes 12 are fabricated as separate electrode portions. The electrode portions may be subsequently coupled to the rear-plate barrier rib 16 of the rear substrate 10.

The dielectric layers 34, 35 covering the sustain electrodes 131, the scan electrodes 132, and the address electrodes 12 may have an MgO protective film 36 on their outer surface (see FIG. 1). In particular, the MgO protective film 36 can be formed on portions that are exposed to the plasma discharge generated in the discharge cells 17.

Further, the sustain electrodes 131, the scan electrodes 132, and the address electrodes 12 are not formed on the front and rear substrates 20, 10, but are formed between these substrates. Accordingly, the protective film 36 that is coated on the dielectric layers 34, 35 covering the sustain electrodes 131, the scan electrodes 132, and the address electrodes 12 may be made of MgO having non-visible-light-transmission property. The non-visible-light-transmission MgO has a secondary electron emission coefficient much higher than that of a visible-light-transmission MgO. Thus, the discharge firing voltage can be further reduced.

The sustain electrode 131 and the scan electrode 132 are provided between the third and fourth barrier rib members 16*b*, 26*b* that constitute two sides (sides along the y-axis direction) of the discharge cells 17. The address electrode 12 is provided between the first and second barrier rib members 16*a*, 26*a* that constitute the other two sides (sides along the y-axis direction) of the discharge cells 17. Nevertheless, one discharge cell 17 must be selected by the address pulse applied to the address electrode 12 and the scan pulse applied to the scan electrode 132.

Accordingly, the protruding portion 132*a* of the scan electrode 132 is located neighboring to the address electrode 12 involved in the address discharge of the discharge cell 17 and distant from the address electrode 12 involved in the address discharge of an adjacent discharge cell 17. That is, the protruding portion 132*a* of the scan electrode 132 is formed to be closer to the address electrode 12 on one side of the discharge cell 17 (see FIGS. 1 and 4).

More specifically, as seen in FIG. 2, the protruding portion 132*a* of the scan electrode 132 is maintained at different distances, d1 and d2, from the two address electrodes located on two sides of each discharge cell 17. The distance d1 is the distance between the address electrode 12 involved in the address discharge of the corresponding discharge cell 17 and the protruding portion 132*a* of the scan electrode 132. The distance d2 is the distance between the address electrode 12 involved in the address discharge of another adjacent discharge cell 17 and the protruding portion 132*a* of the scan electrode 132. The distance d1 is formed to be shorter than the distance d2 (d1<d2).

Further, the address electrode 12 is surrounded by the dielectric layer 35 having the same dielectric constant and the same discharge firing voltage for red (R), green (G), and blue (B) phosphors. Accordingly, during the address discharge, a high voltage margin can be obtained.

Figure 5:
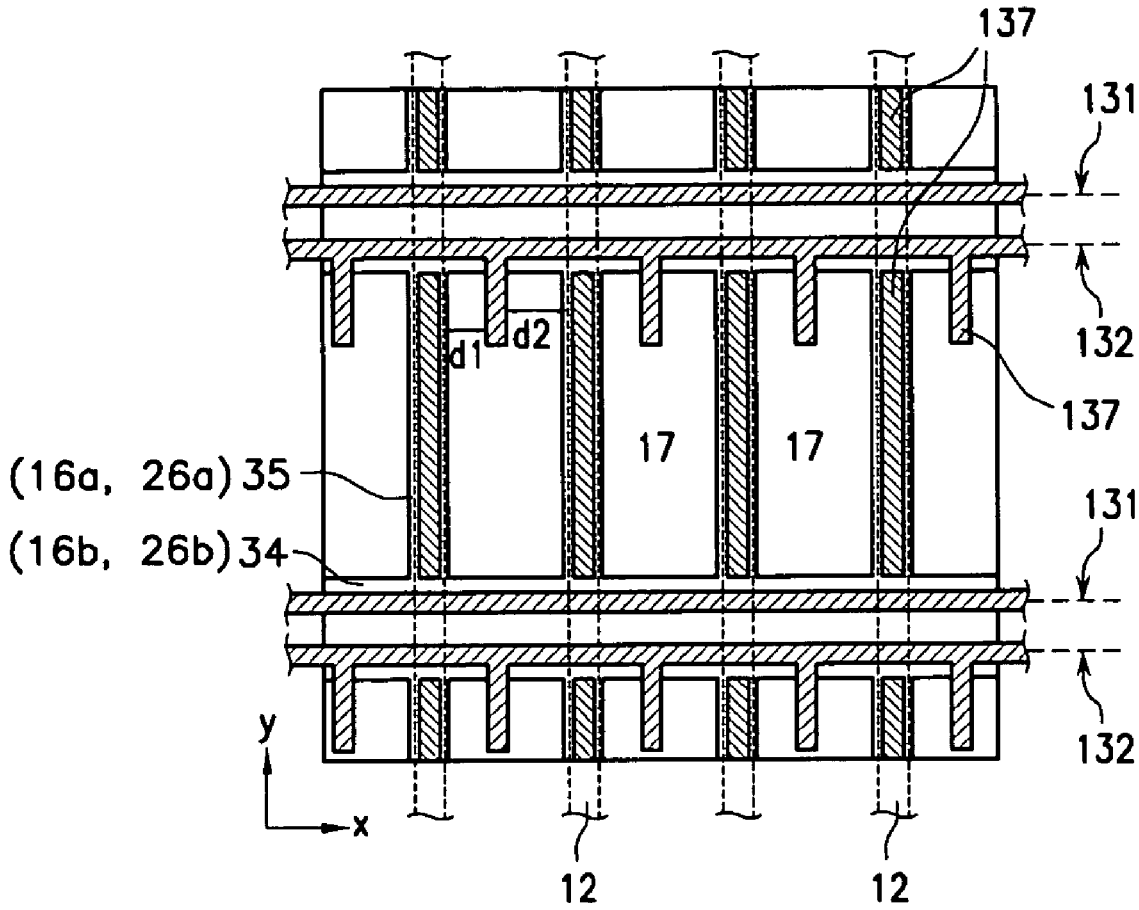
FIG. 5 is a plan view of discharge cells and a black layer in the PDP of the first embodiment of the present invention.

FIG. 5 is a plan view of discharge cells and a black layer in the PDP of the first embodiment of the present invention. A black layer 137 is provided on the front substrate 20, which was omitted in FIG. 1 for convenience. The black layer 137 absorbs external light to enhance contrast.

The black layer 137 may be formed on the surface of the front substrate 20 and may be covered with the second phosphor layer 29 (see FIG. 3). Alternatively, the black layer (not shown) may be formed on the second phosphor layer 29 of the front substrate 20.

In one embodiment, the black layer 137 is formed in a shape corresponding to the address, sustain, and scan electrodes 12, 131, 132 with respect to the plane of the front substrate 20 (the x-y plane). The black layer 137 may be formed in a shape corresponding to the protruding portion 132*a* of the scan electrode 132 (see FIG. 5).

Accordingly, the black layer 137 absorbs external light to enhance contrast. The black layer 137 also prevents visible light generated in the discharge cells 17 and passing through the front substrate 20 from being shielded in addition to the portion that is shielded by the electrodes. Accordingly, the luminescence efficiency can be improved.

More embodiments are discussed below where the description of similar parts are omitted.

Figure 6:
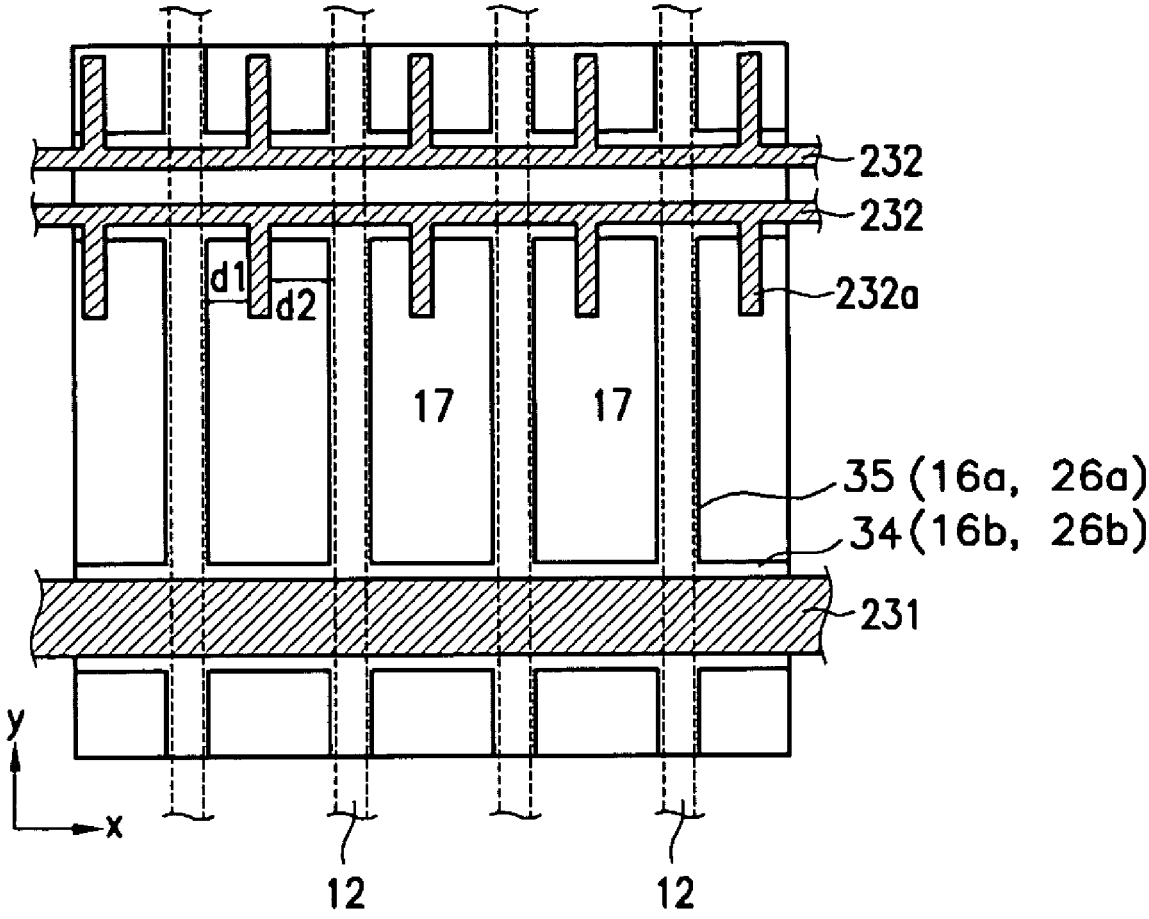
FIG. 6 is a plan view of electrodes and discharge cells in a PDP according to a second embodiment of the present invention.

FIG. 6 is a plan view of electrodes and discharge cells in a PDP according to a second embodiment of the present invention. Sustain electrodes 231 and scan electrodes 232 are located in parallel pairs along a direction (x-axis direction) crossing the direction of the address electrodes 12 (y-axis direction). In two adjacent discharge cells 17, located along the direction of the address electrodes 12 (along the y-axis direction), the sustain and scan electrodes 231, 232 alternate but the scan electrodes 232 of the two adjacent discharge cells 28, 28 are also adjacent. In other words, the sustain and scan electrodes 231, 232 are located in the following order: the sustain electrode 231, the scan electrode 232, another scan electrode 232, and then the sustain electrode 231, followed by another pair of adjacent scan electrodes 232, 232.

In this embodiment, between the third and fourth barrier rib members 16*b*, 26*b* of one side of the discharge cell 17, two scan electrodes 232 for two adjacent discharge cells 17 are provided. The sustain electrode 231 is provided between the third and fourth barrier rib members 16*b*, 26*b* of the other side of the discharge cell 17. The sustain electrode 231 may be shared by adjacent discharge cells 17.

Figure 7:
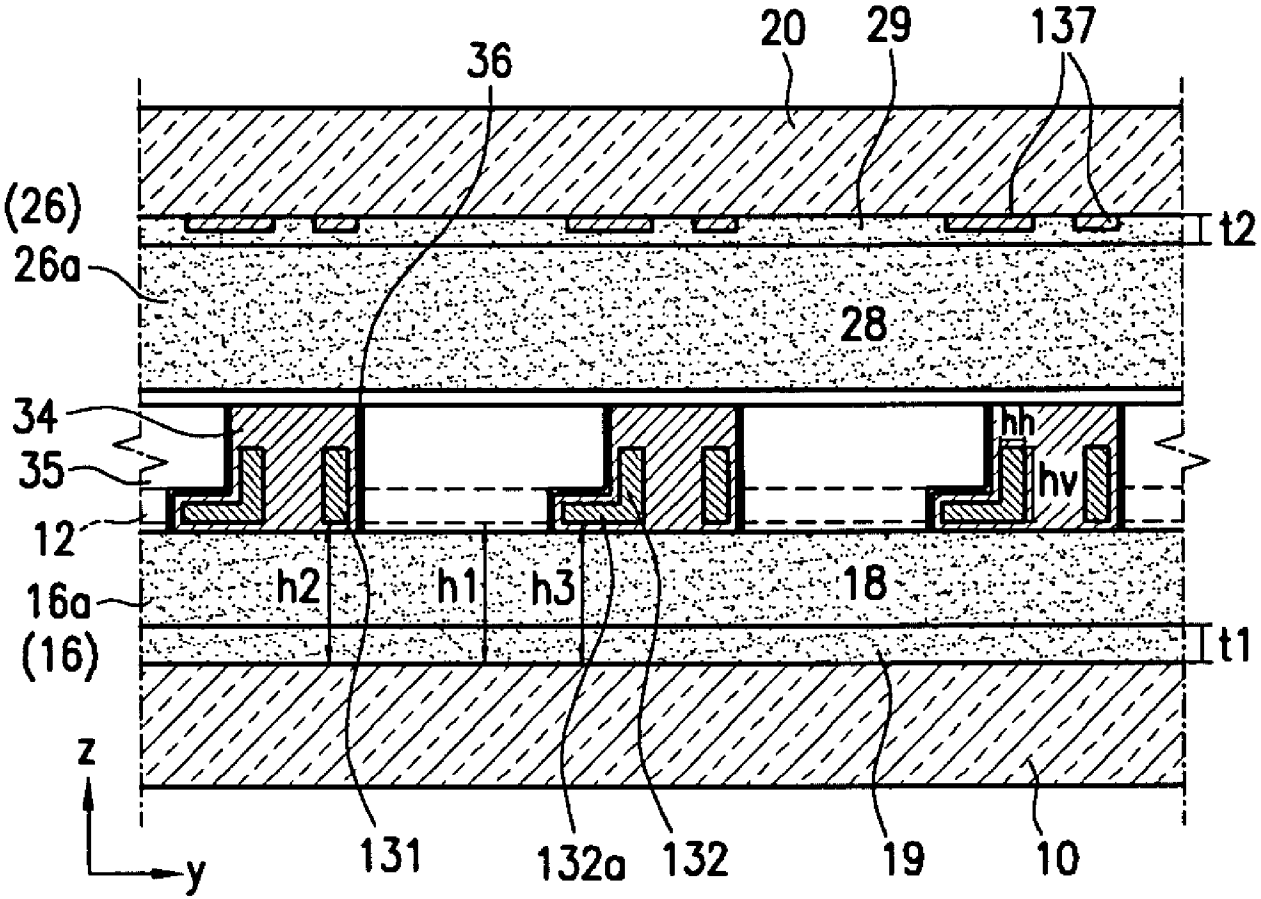
FIG. 7 is a cross-sectional view of a PDP according to a third embodiment of the present invention.

FIG. 7 is a cross-sectional view of a PDP according to a third embodiment of the present invention. This figure is the counterpart of the cross-sectional view of the first embodiment shown in FIG. 3. The rear-plate barrier rib 16 has the first barrier rib members 16*a* that are formed in parallel to the address electrodes 12, and the front-plate barrier rib 26 has second barrier rib members 26*a* that are formed in parallel to the address electrodes 12. In this embodiment, there are no third or fourth barrier rib members formed across the direction of the address electrodes 12. Accordingly, the discharge cells 17 are formed in stripes where the discharge cells 17 are connected together along the direction of the address electrodes 12 (y-axis direction).

Figure 8:
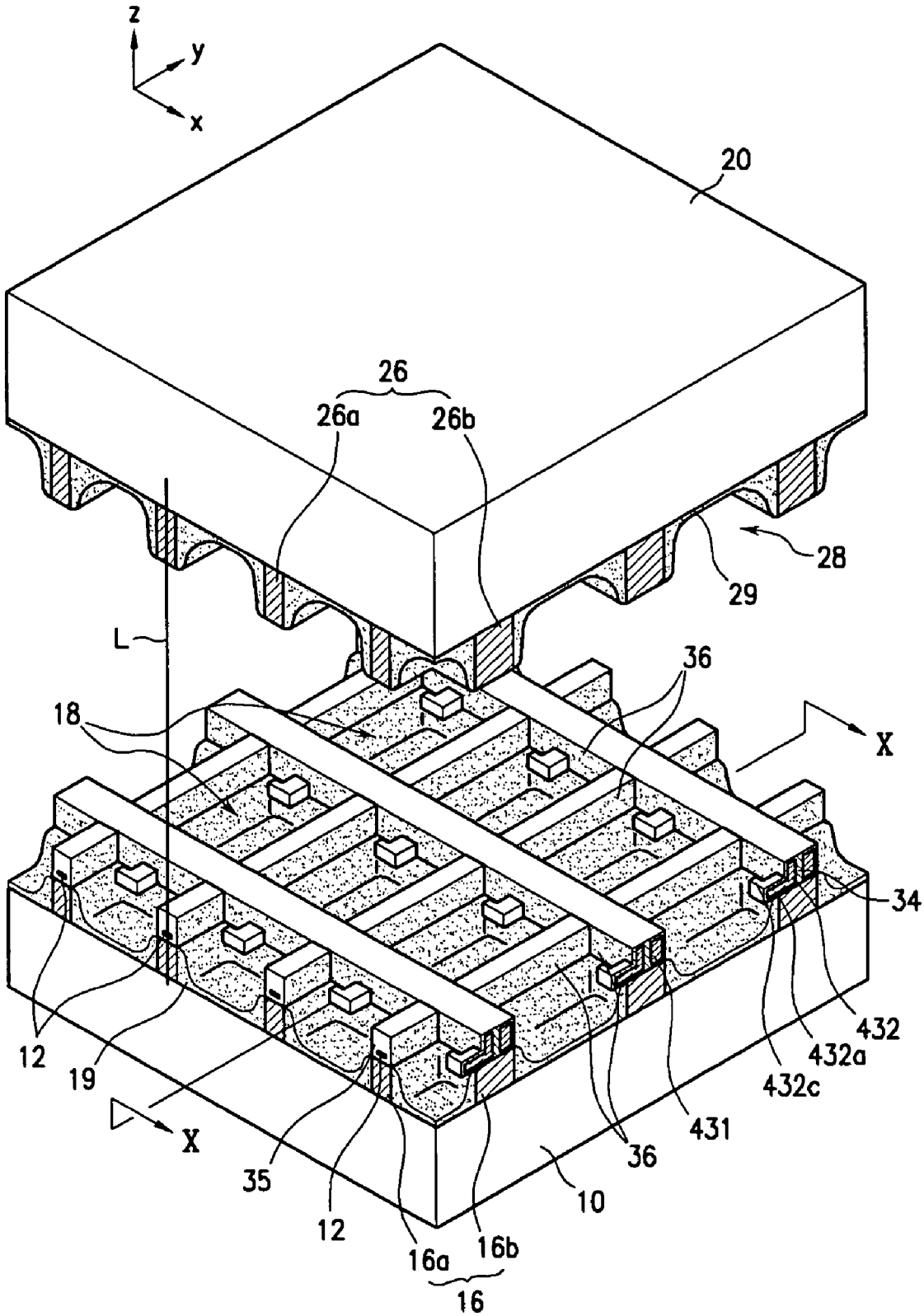
FIG. 8 is a partial exploded perspective view of a PDP according to a fourth embodiment of the present invention.
Figure 9:
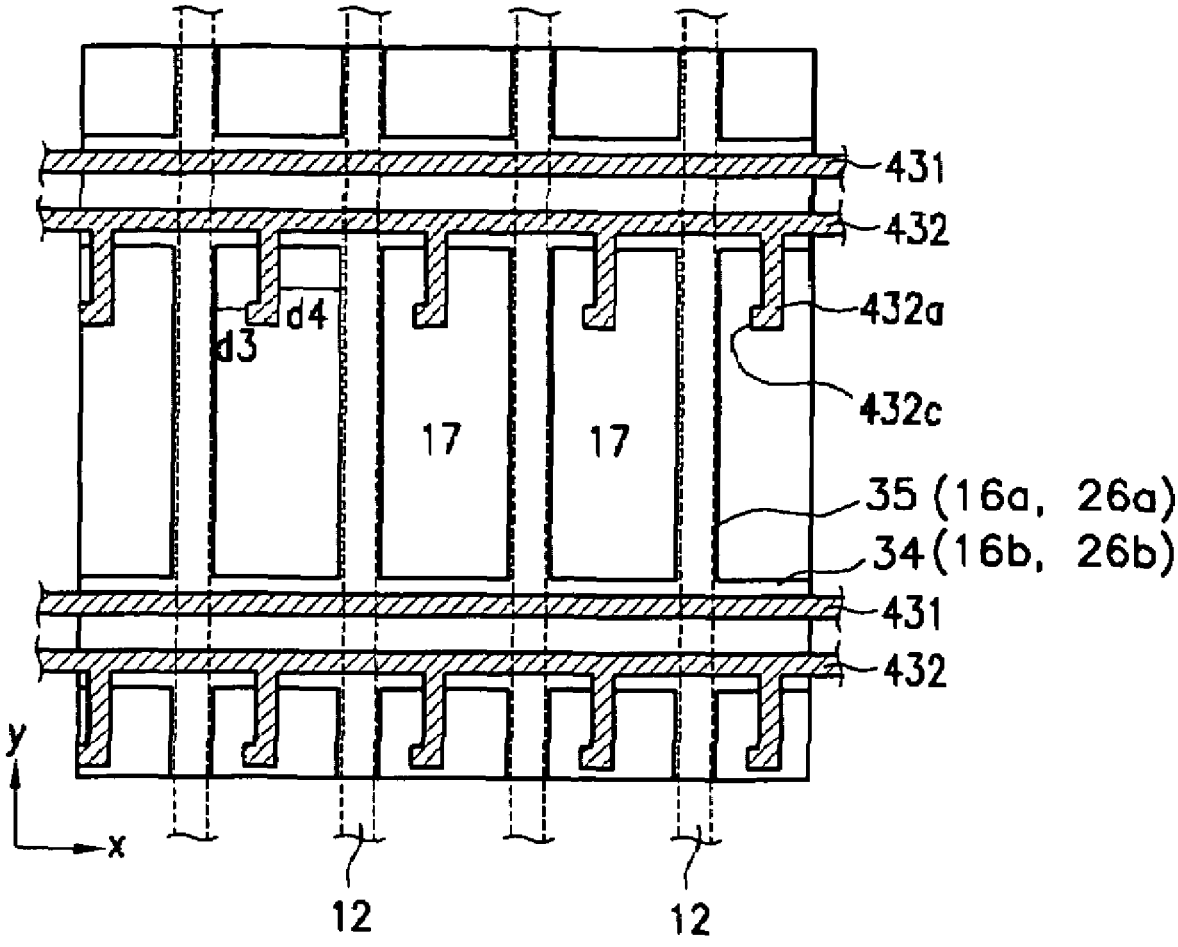
FIG. 9 is a plan view of electrodes and discharge cells in the PDP of the fourth embodiment of the present invention.
Figure 10:
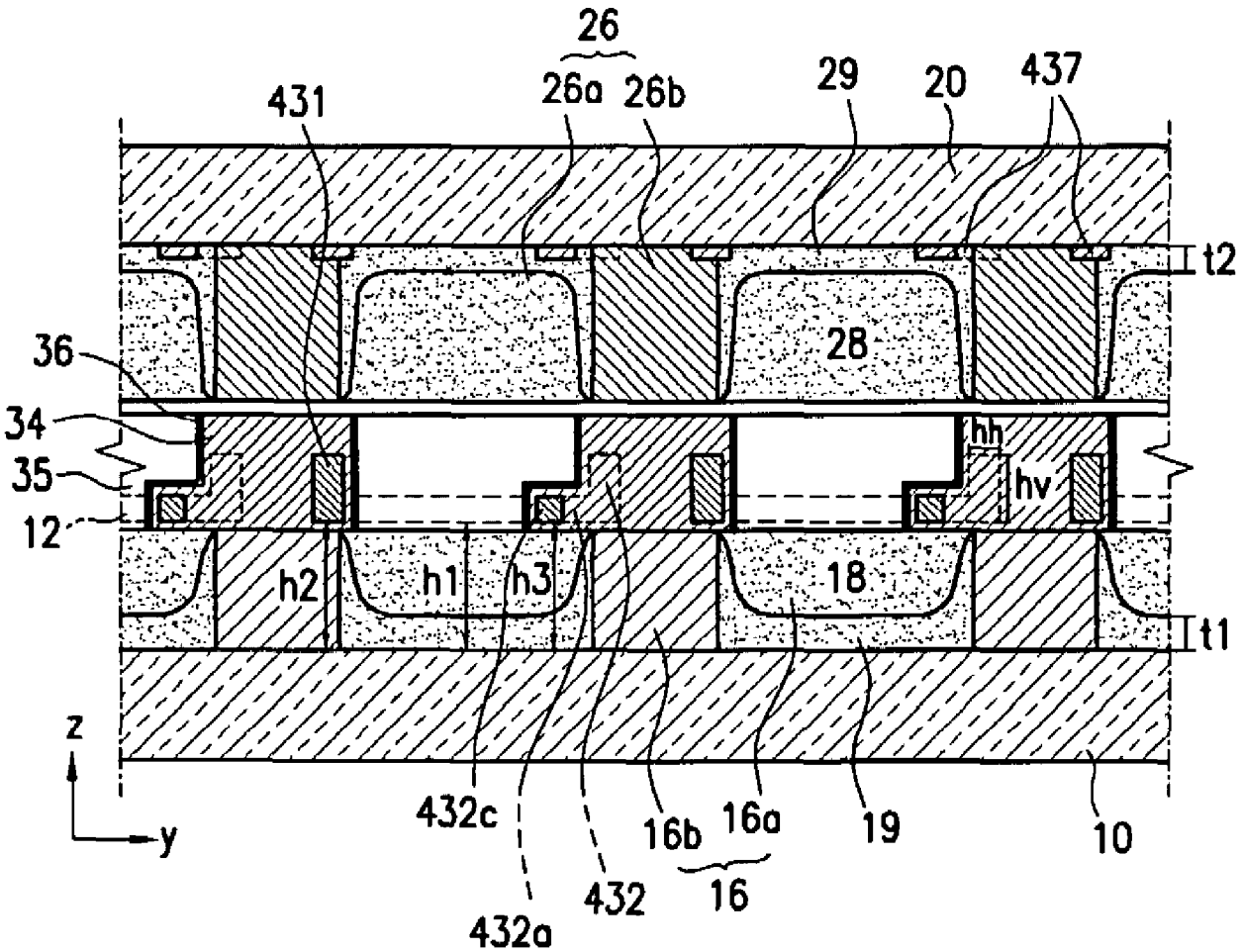
FIG. 10 is a cross-sectional view taken along the line X-X of FIG. 8.
Figure 11:
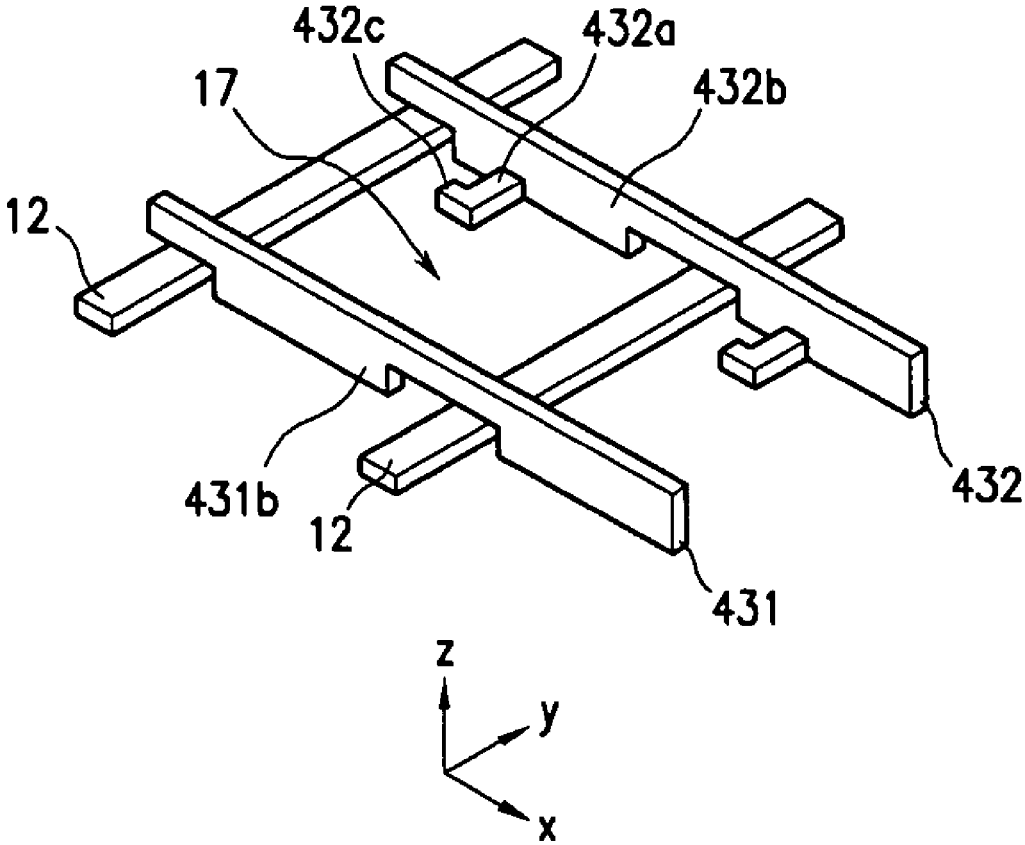
FIG. 11 is a perspective view showing structures of electrodes in the PDP of the fourth embodiment of the present invention.
Figure 12:
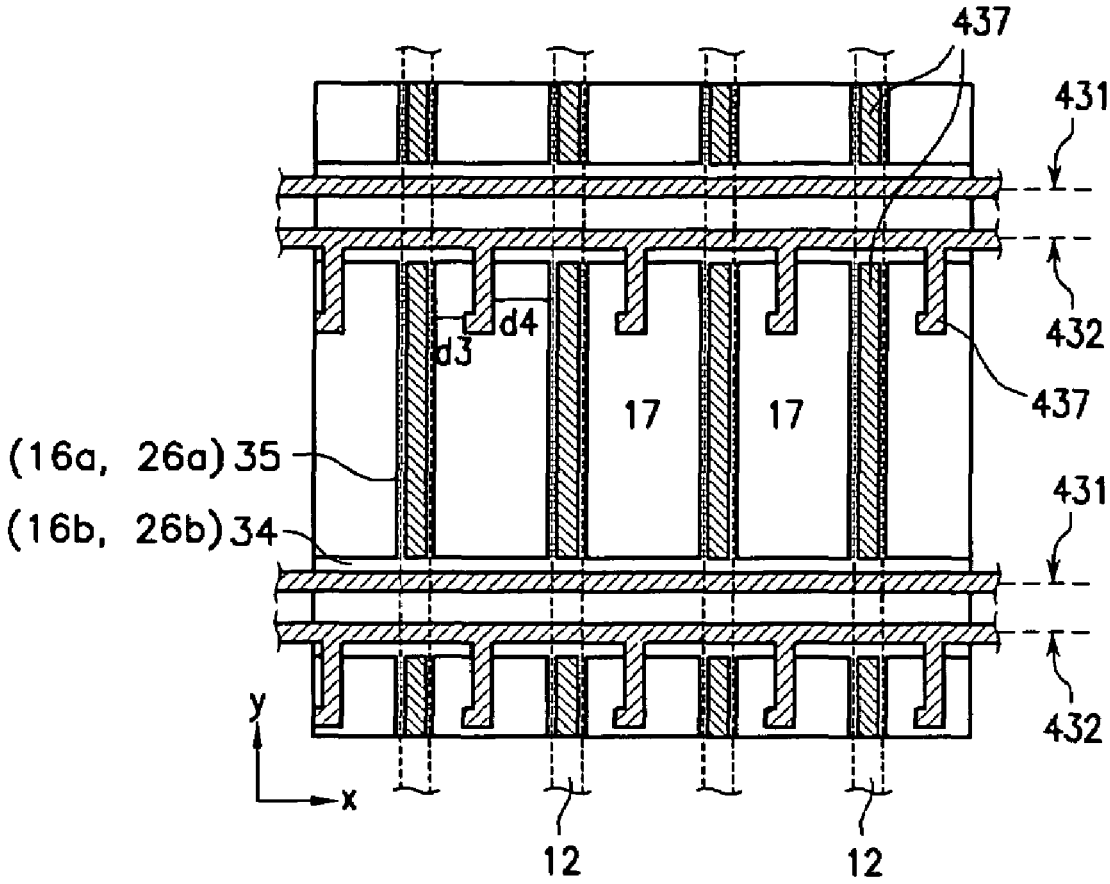
FIG. 12 is a plan view of discharge cells and a black layer in the PDP of the fourth embodiment of the present invention.

FIG. 8 is a partial exploded perspective view of a PDP according to a fourth embodiment of the present invention. FIG. 9 is a plan view of electrodes and discharge cells in the PDP of the fourth embodiment. FIG. 10 is a cross-sectional view taken along the line X-X of FIG. 8. FIG. 11 is a perspective view of electrodes in the PDP of the fourth embodiment. FIG. 12 is a plan view of discharge cells and a black layer in the PDP of the fourth embodiment. These drawings correspond to FIGS. 1, 2, 3, 4, and 5 of the first embodiment.

In the fourth embodiment, a protrusion 432*c* is further provided in a protruding portion 432*a* of a scan electrode 432. The protruding portion 432*a* of the scan electrode 432 is closer to the address electrode 12 on one side of the discharge cell 17, and thus the protrusion 432*c* formed on the protruding portion 432*a* is even closer to this address electrode 12.

The protruding portion 432*a* is formed to protrude from the expansion portion 432*b* toward the center of the discharge cell 17 and the protrusion 432*c* is formed to protrude from the protruding portion 432*a* toward one of the address electrodes 12 on one side of the discharge cells 17.

Therefore, the protruding portion 432*a* of the scan electrode 432 and its protrusion 432*c* form a shorter gap with the address electrode 12 of one side of the discharge cell 17, and the address discharge can be generated with a low voltage. The protrusion 432*c* facing the address electrode 12 of one side is formed in the protruding portion 432*a*, and thus the protruding portion 432*a* of the scan electrode 432 may not be inclined to the address electrode 12 on the other side of the discharge cell 17.

As seen in FIG. 9, by providing the protrusion 432*c*, the distance d3 between the protrusion 432*c* of the scan electrode 432 and the address electrode 12 on one side of the discharge cell 17 is shorter than the distance d4 between the protruding portion 432*a* of the scan electrode 432 and the address electrode 12 on the other side of the discharge cell 17 (d3<d4).

During the address discharge with the address electrode 12, the protrusion 432*c* further limits the discharge to the peripheries of the protrusion 432*c*, such that unwanted light generated during the address discharge can be further reduced. As described above, light generated during the address discharge has a bad effect upon the image display by the sustain discharge.

The black layer 437 is formed on the front substrate 20 in a shape corresponding to the address electrode 12, the sustain electrode 431, and the scan electrode 432, similar to the first embodiment. In one embodiment, the black layer 437 is further formed corresponding to the protrusion 432*c* formed in the protruding portion 432*a* of the scan electrode 432 (see FIG. 12). For convenience, the black layer has been omitted in FIG. 8.

The sustain electrodes 431 and the scan electrodes 432 are alternately located in parallel along a direction (x-axis direction) crossing the direction of the address electrodes 12 (y-axis direction). In two adjacent discharge cells 17, located alongside an address electrode 12, the sustain and scan electrodes 431, 432 have the following order: on one side of one of the discharge cells, one scan electrode 432 is adjacent a sustain electrode 431 followed by a scan electrode 432 adjacent a sustain electrode 431, on the other side of the discharge cell, and the pattern repeating. In this embodiment, the scan electrode 432 of one of the adjacent discharge cells 17 and the sustain electrode 431 of the other discharge cell 17 are located between the same third and fourth barrier rib members 16*b*, 26*b* between the two discharge cells 17, (see FIG. 9).

Figure 13:
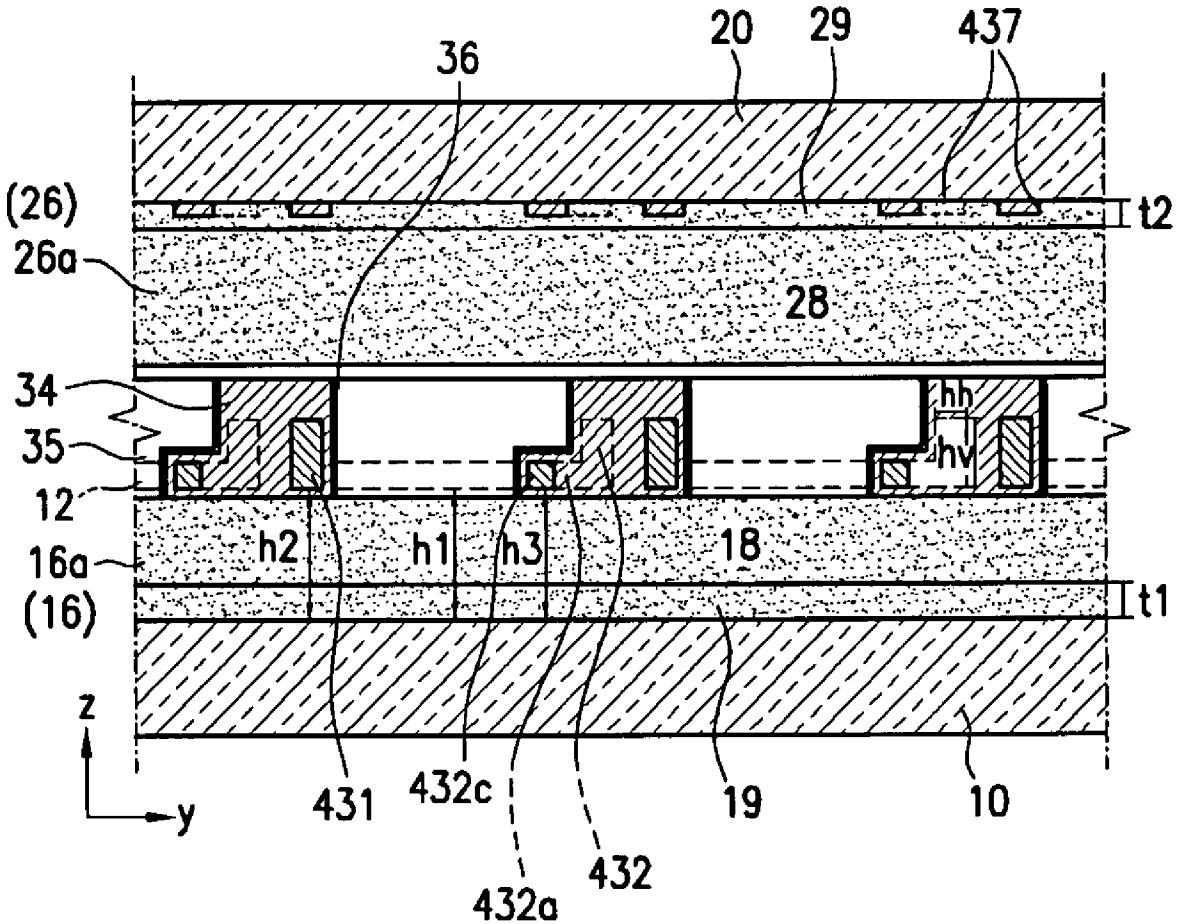
FIG. 13 is a cross-sectional view of a PDP according to a fifth embodiment of the present invention.

FIG. 13 relates to a fifth embodiment, where the structures of the rear-plate barrier rib 16 and the front-plate barrier rib 26 of the third embodiment are applied to the configuration of the fourth embodiment. That is, the rear-plate barrier rib 16 of the fifth embodiment has the first barrier rib members 16*a* that are formed parallel to the address electrodes 12 and the front-plate barrier rib 26 has the second barrier rib members 26*a* that are formed parallel to the address electrodes 12. These barrier ribs 16, 26, however, do not have any third or fourth barrier-rib members. Accordingly, the discharge cells 17 are continuously connected in stripes along the address electrodes 12 (y-axis direction).

Figure 14:
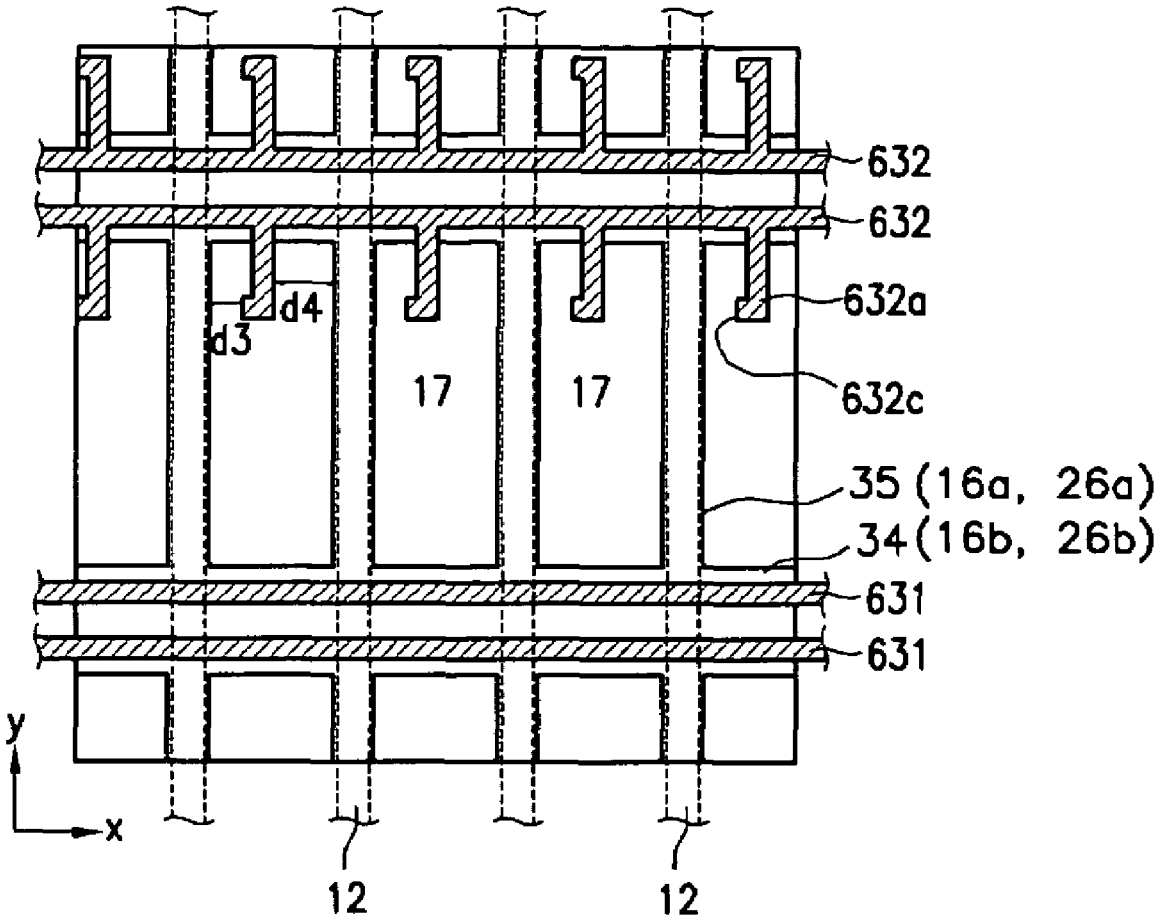
FIG. 14 is a plan view of electrodes and discharge cells in a PDP according to a sixth embodiment of the present invention.
Figure 15:
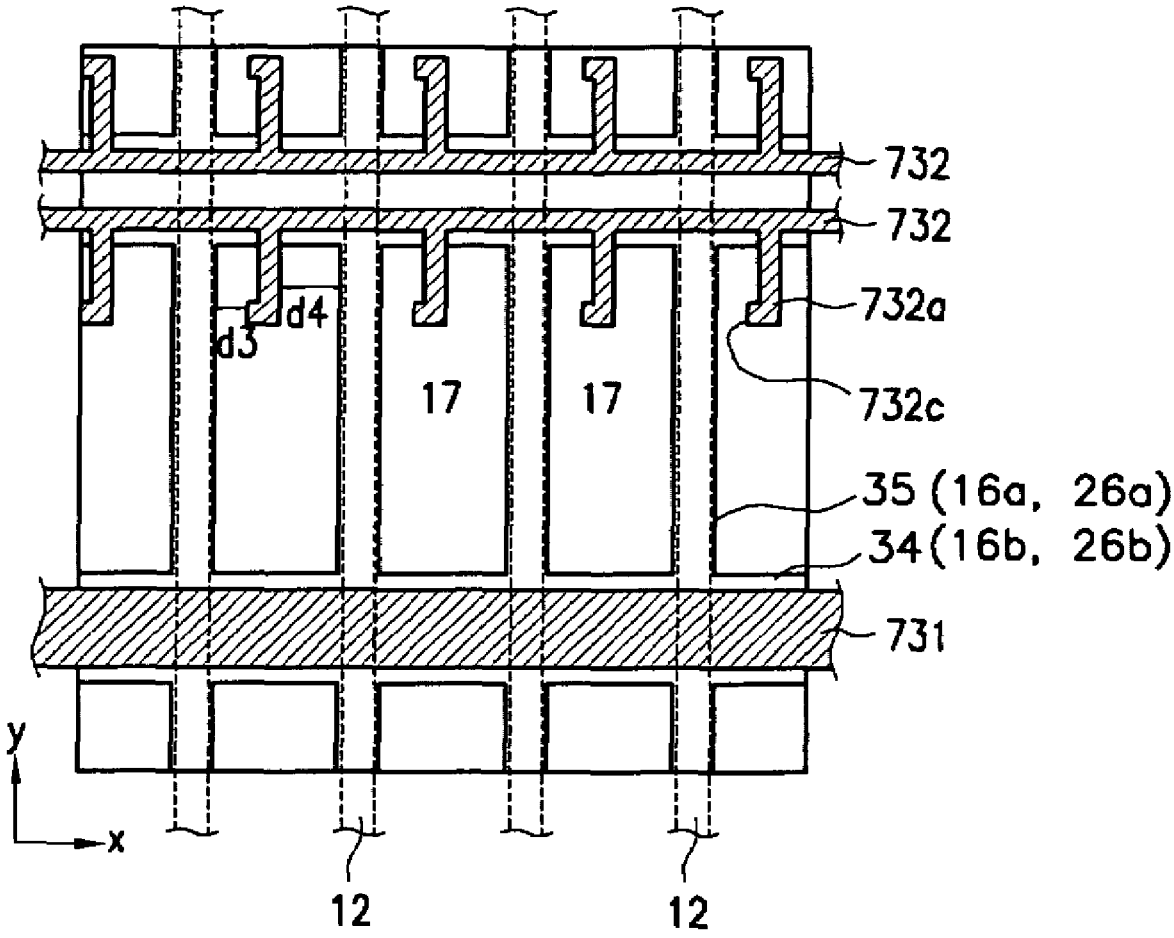
FIG. 15 is a plan view of electrodes and discharge cells in a PDP according to a seventh embodiment of the present invention.

FIGS. 14 and 15 relate to sixth and seventh embodiments of the present invention, respectively. As shown in FIG. 14, the sustain electrodes 631 and the scan electrodes 632 are located in pairs extending along the x-axis direction of the figure and crossing the direction of the address electrodes 12. In two adjacent discharge cells 17, the two sustain electrodes 631 are located adjacent to each other on one side of one of the discharge cells 17 and the two scan electrodes 632 are located adjacent to each other on the other side of the same discharge cell 17, followed by another pair of adjacent sustain electrodes 631 located on the nonadjacent side of the other discharge cell 17. As a result, the sustain and scan electrodes are located according to the following order: one sustain electrode 631 for the first discharge cell followed by two scan electrodes 632 each corresponding to one of the two adjacent discharge cells, followed by the sustain electrode 631 of the second discharge cell.

In this sixth embodiment, either a pair of scan electrodes 632 or a pair of sustain electrodes 631 are located between each pair of the third and fourth barrier rib members 16*b*, 26*b* on one side of a discharge cell 17.

In the seventh embodiment, shown in FIG. 15, one sustain electrode 731 may be shared by adjacent discharge cells 17.

FIGS. 16, 17, 18, and 19 are plan views of electrodes and discharge cells in eighth, ninth, tenth, and eleventh embodiments of the present invention, respectively. These figures show various embodiments of the dielectric layer 34 formed to surround the protruding portions and the protrusions of the scan electrodes.

Scan electrode 832 of the eighth embodiment, has a protruding portion 832*a* and a protrusion 832*c*. Scan electrode 932 of the ninth embodiment, has a protruding portion 932*a*. Scan electrode 1032 of the tenth embodiment, has a protruding portion 1032*a* and a protrusion 1032*c*. Scan electrode 1132 of the eleventh embodiment, has a protruding portion 1132*a* and a protrusion 1132*c*.

The thicknesses and the shapes of the dielectric layers 34*a*, 34*b*, 34*c*, 34*d* formed on the peripheries of the protruding portions 832*a*, 932*a*, 1032*a*, 1132*a* of the scan electrodes 832, 932, 1032, 1132, and in the peripheries of the protrusions 832*c*, 1032*c*, 1132*c*, may be suitably controlled. The thickness of the dielectric layers 34*a*, 34*b*, 34*c*, 34*d* may be smaller than the thickness of the dielectric layer 34 formed on any other portion. Then, the plasma discharge generated during the address discharge between the scan electrode 832, 932, 1032, 1132 and the address electrode 12 will be limited to the periphery of the dielectric layer 34*a*, 34*b*, 34*c*, 34*d* having the smaller thicknesses. Accordingly, the amount of unwanted light generated during the address discharge is reduced.

Figure 16:
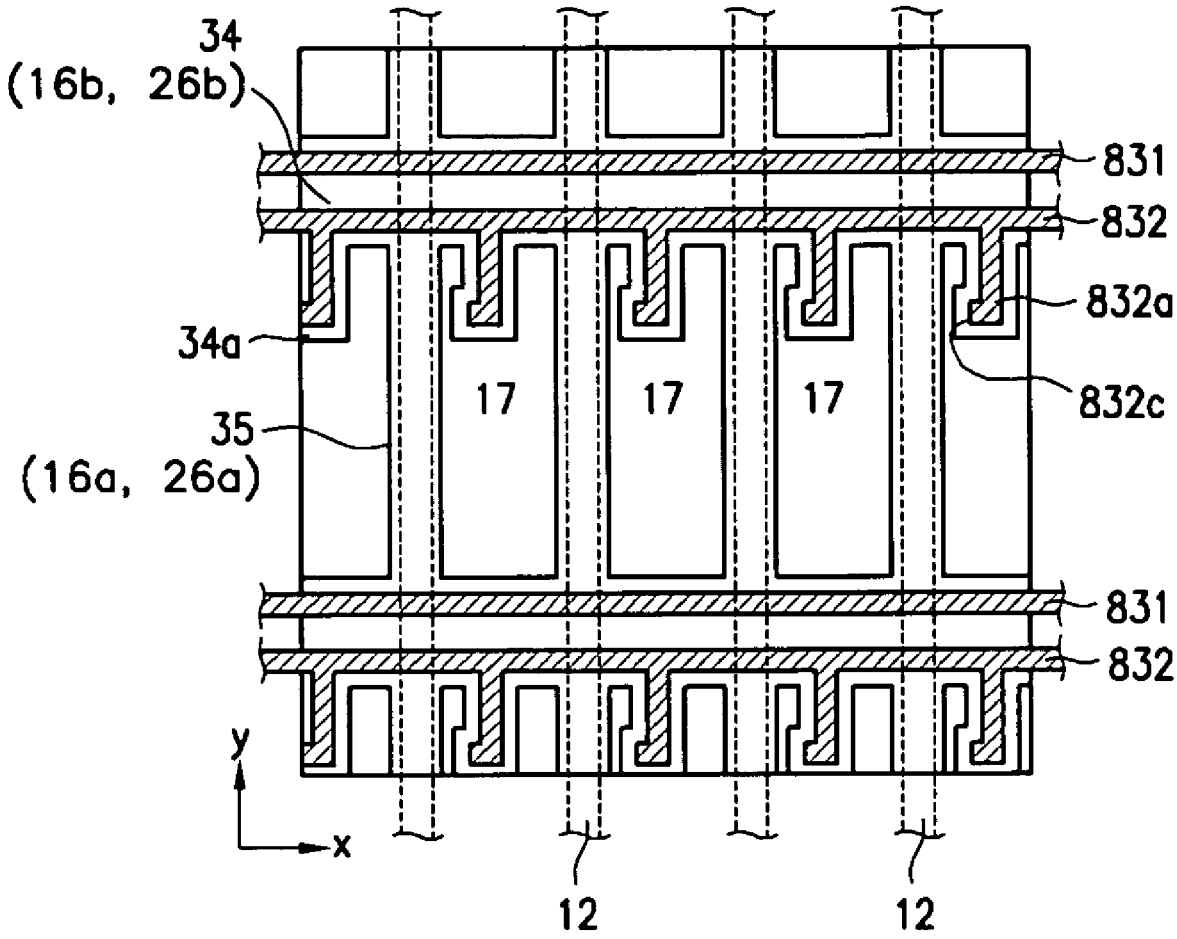
FIG. 16 is a plan view of electrodes and discharge cells in a PDP according to an eighth embodiment of the present invention.

In the eighth embodiment shown in FIG. 16, the dielectric layer 34*a* provided around the peripheries of the protruding portion 832*a* and the protrusion 832*c* of the scan electrode 832 has a uniform thickness. Accordingly, the address discharge will be concentrated between the protrusion 832*c* and the address electrode 12.

Figure 17:
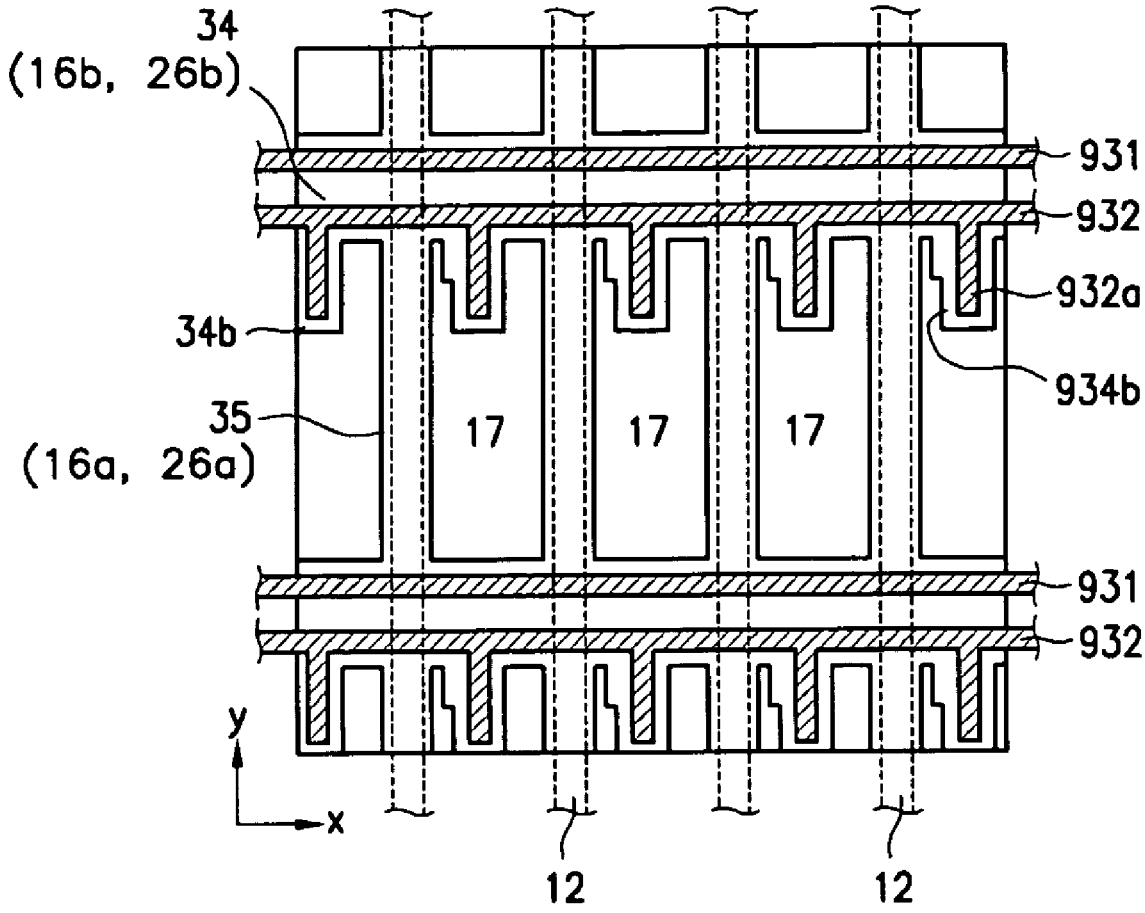
FIG. 17 is a plan view of electrodes and discharge cells in a PDP according to a ninth embodiment of the present invention.

In the ninth embodiment shown in FIG. 17, the dielectric layer 34*b* formed on a front end of the protruding portion 932*a* of the scan electrode 932 is thinner than the dielectric layer 34 elsewhere. Accordingly, the address discharge will be concentrated in the area where the dielectric layer 34*b* having the smaller thickness is covering the protruding portion 932*a*.

Figure 18:
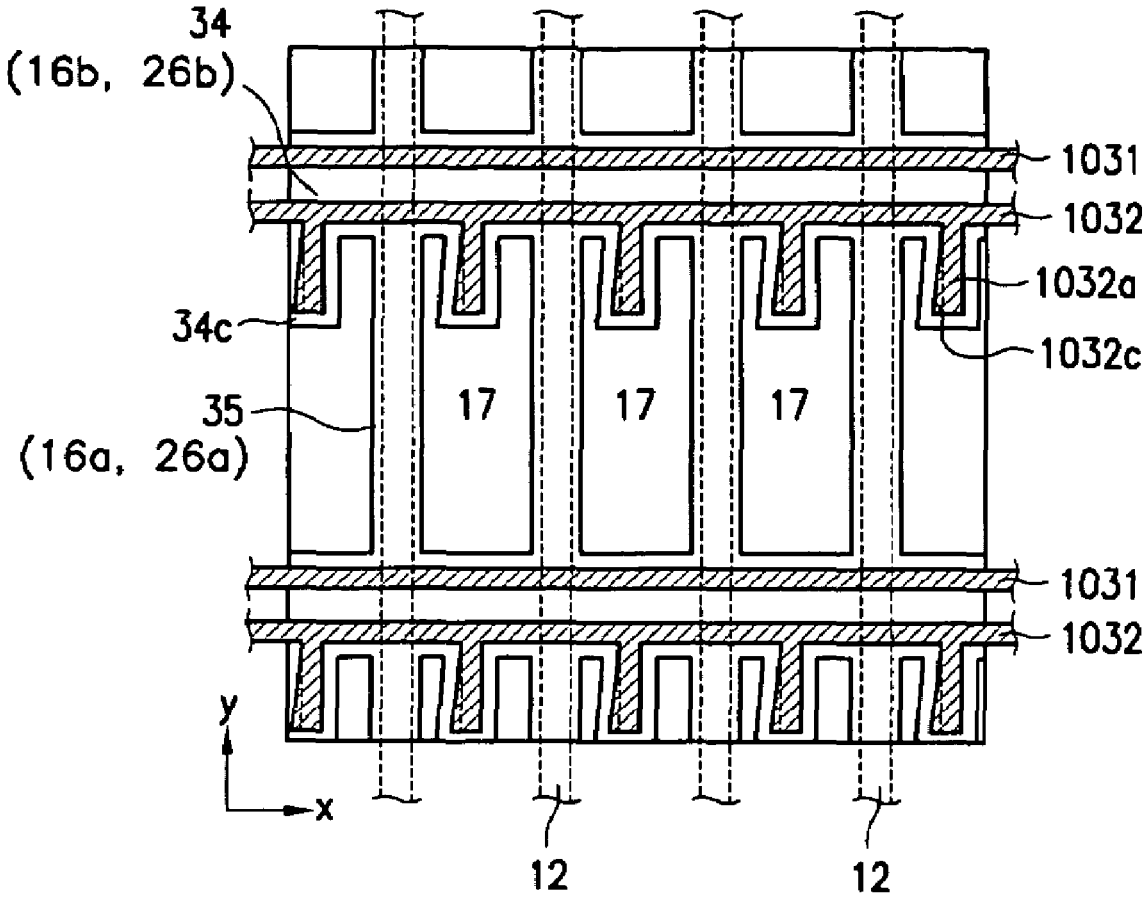
FIG. 18 is a plan view of electrodes and discharge cells in a PDP according to a tenth embodiment of the present invention.

In the tenth embodiment shown in FIG. 18, the scan electrode 1032 has a protruding portion 1032*a* and the protrusion 1032*c*. The protrusion 1032*c* is formed in the protruding portion 1032*a* and has a wider area than the protruding portion 1032*a*. The dielectric layer 34*c* formed on the protruding portion 1032*a* and the protrusion 1032*c* of the scan electrode 1032 may have a uniform thickness or may be thinner than any other portion of the dielectric 34. Accordingly, the widened protrusion 1032*c* concentrates the address discharge between the front end of the protruding portion 1032*a* and the address electrode 12.

Figure 19:
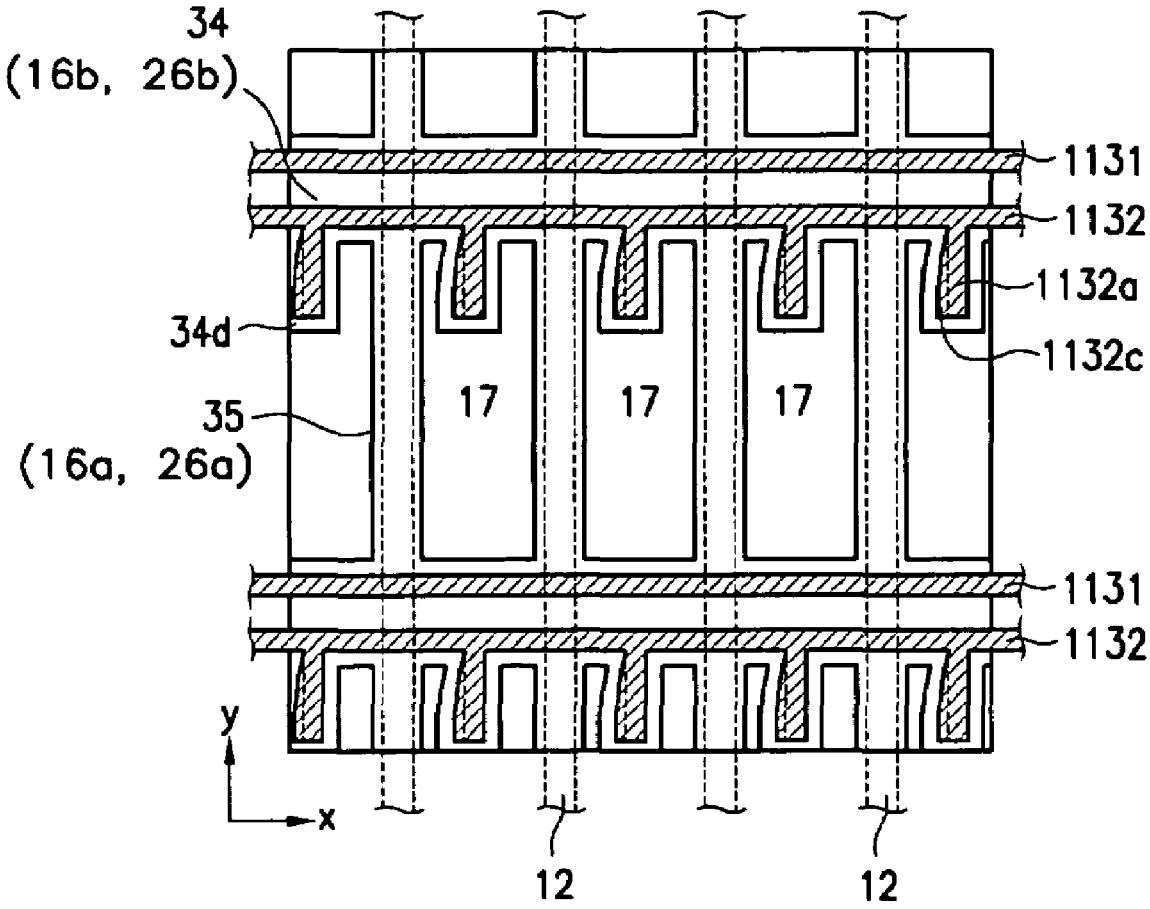
FIG. 19 is a plan view of electrodes and discharge cells in a PDP according to an eleventh embodiment of the present invention.

The eleventh embodiment shown in FIG. 19 is a modification of the tenth embodiment shown in FIG. 18. A protrusion 1132*c* formed in the protruding portion 1132*a* has a curved shape. The convex part of the curved protrusion 1132*c* faces the address electrode 12 and concentrates the address discharge between the address and scan electrodes 12, 1132 at the curved portion.

Figure 20:
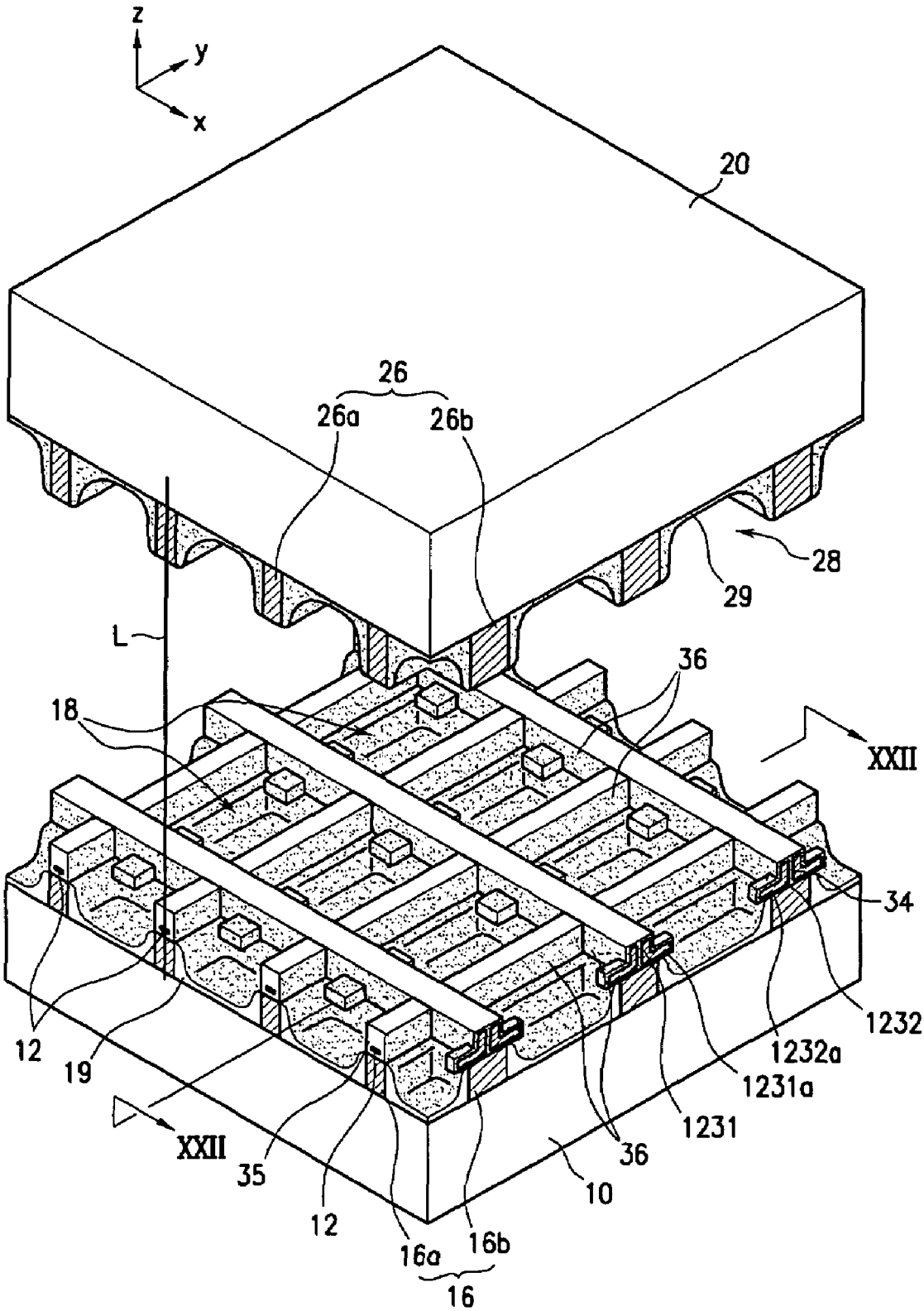
FIG. 20 is a partial exploded perspective view showing a PDP according to a twelfth embodiment of the present invention.
Figure 21:
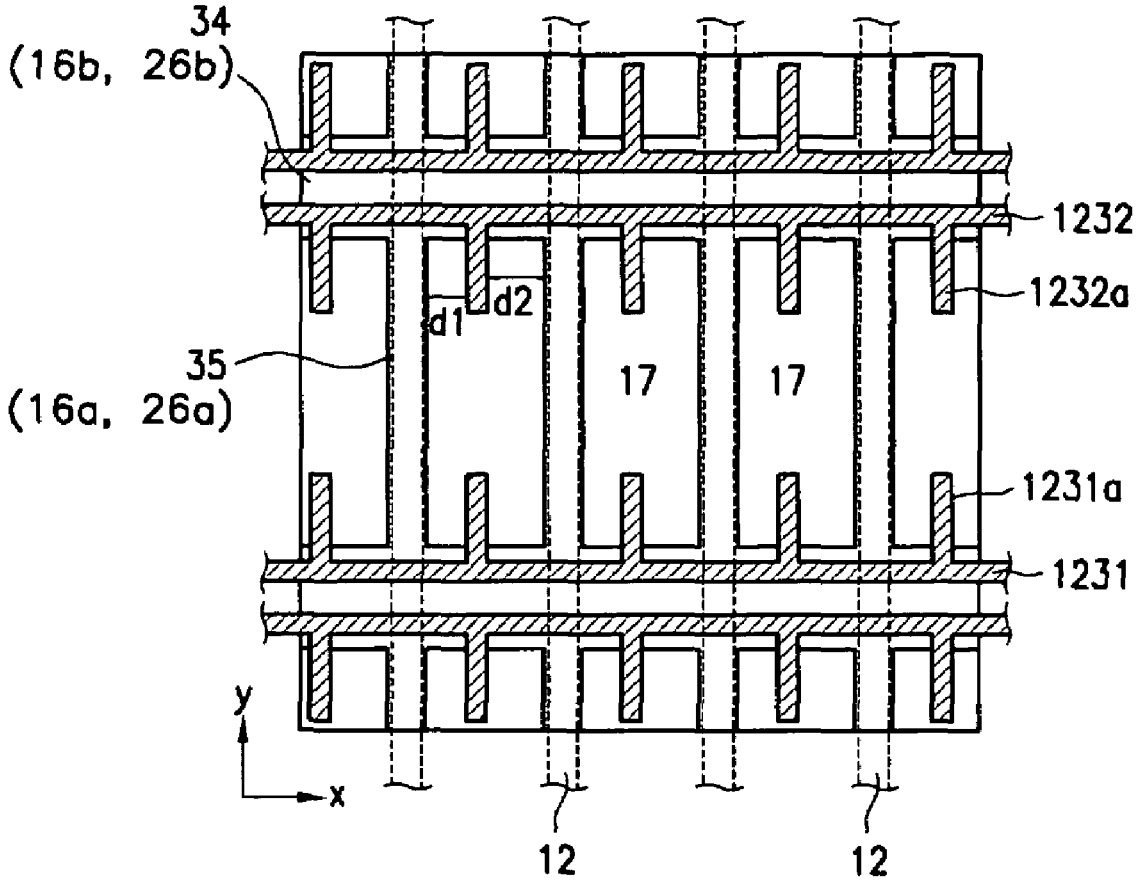
FIG. 21 is a plan view of electrodes and discharge cells in the PDP of the twelfth embodiment of the present invention.
Figure 22:
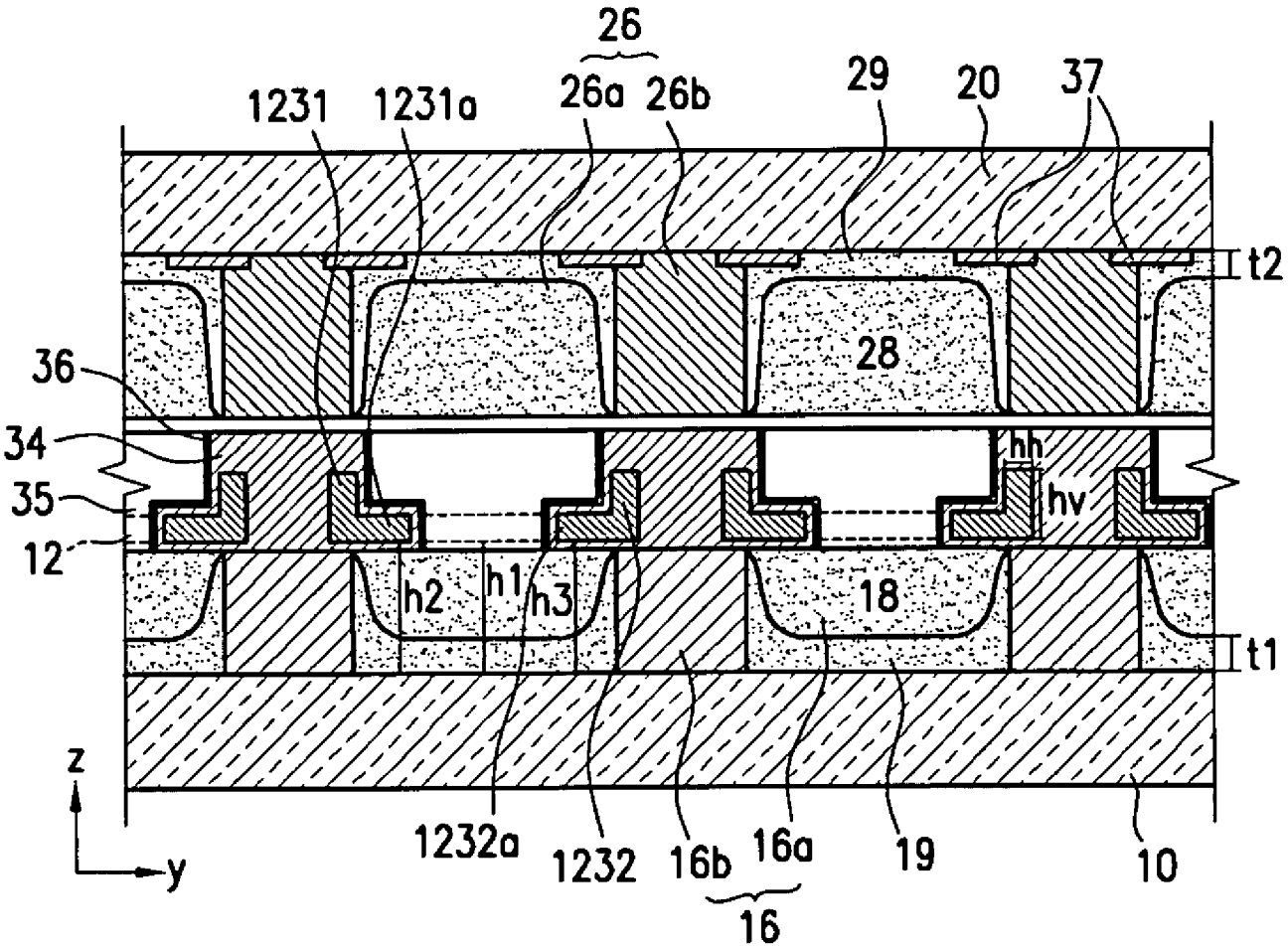
FIG. 22 is a cross-sectional view taken along the line XXII-XXII of FIG. 20.

FIG. 20 is a partial perspective view showing a PDP according to a twelfth embodiment of the present invention. FIG. 21 is a plan view of electrodes and discharge cells in the PDP of the twelfth embodiment. FIG. 22 is a cross-sectional view taken along the line XXII-XXII of FIG. 20.

In the twelfth embodiment a sustain electrode 1231 has a protruding portion 1231*a*. The sustain electrode 1231 and a scan electrode 1232 are located on two sides of the discharge cell 17 and both have protruding portions 1231*a*, 1232*a* that protrude toward the center of the discharge cell 17. The discharge gap between the sustain and scan electrodes 1231, 1232 in the discharge cell 17, is formed between the protruding portions 1231*a*, 1232*a*. The gap between the protruding portions 1231*a*, 1232*a* is shorter than the distance between the sustain and scan electrodes 1231, 1232 themselves. The shorter gap reduces the discharge firing voltage at the beginning of the sustain discharge.

The protruding portions 1231*a*, 1232*a* carry the voltages applied to the sustain electrode 1231 and the scan electrode 1232 to the center of the discharge cell 17 and, in one embodiment, are formed to protrude from expansion portions 1231*b*, 1232*b* having wider areas than other portions.

Figure 23:
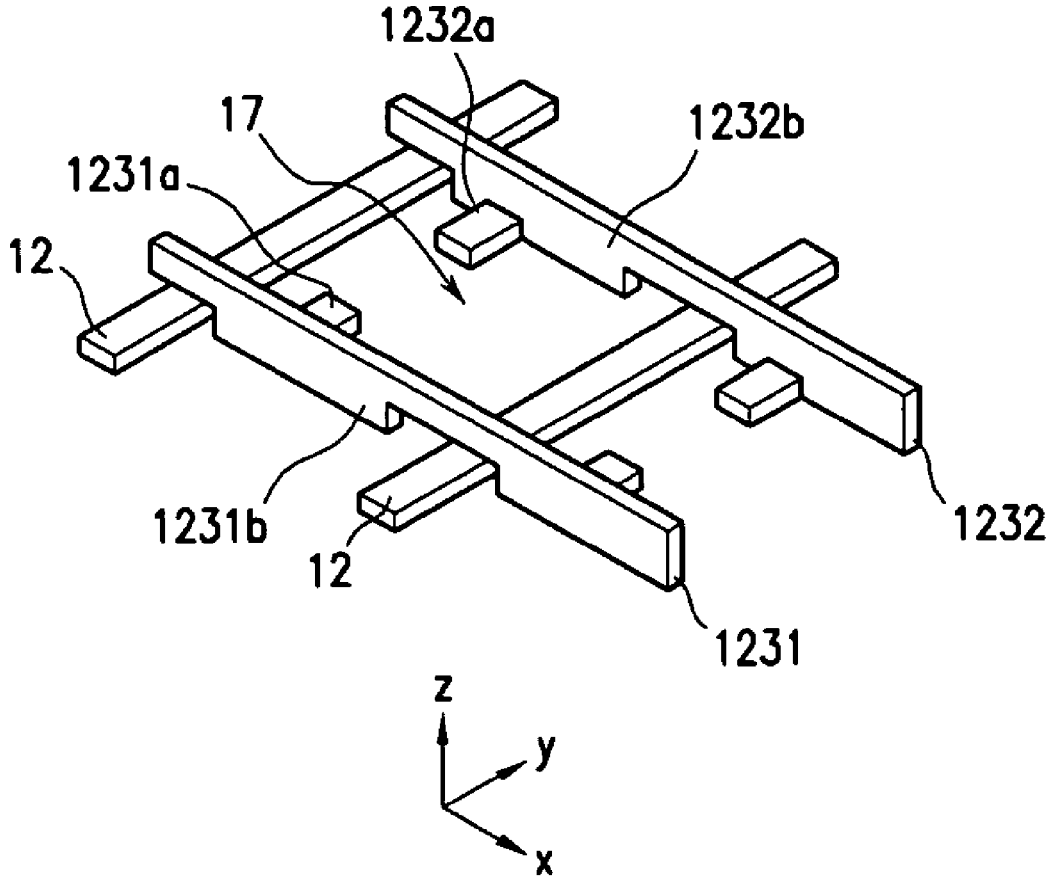
FIG. 23 is a perspective view of electrodes in the PDP of the twelfth embodiment of the present invention.

The protruding portions 1231*a*, 1232*a* can have various shapes. The protruding portions 1231*a*, 1232*a* are, in one embodiment, formed to protrude in angular shapes, for example, in the shape of a hexahedron. Then, the opposing electrode discharge is easily induced at front ends of the angular protruding portion 1232*a* of the scan electrode 1232 and the address electrode 12 (see FIG. 23).

The sustain electrode 1231 and the scan electrode 1232 induce the sustain discharge with low voltage between their protruding portions 1231*a*, 1232*a* and then induce the full-scale sustain discharge across the long gap between the expansion portions 1231*b*, 1232*b*. Accordingly, the discharge firing voltage can be reduced while the luminescence efficiency is increased.

Figure 24:
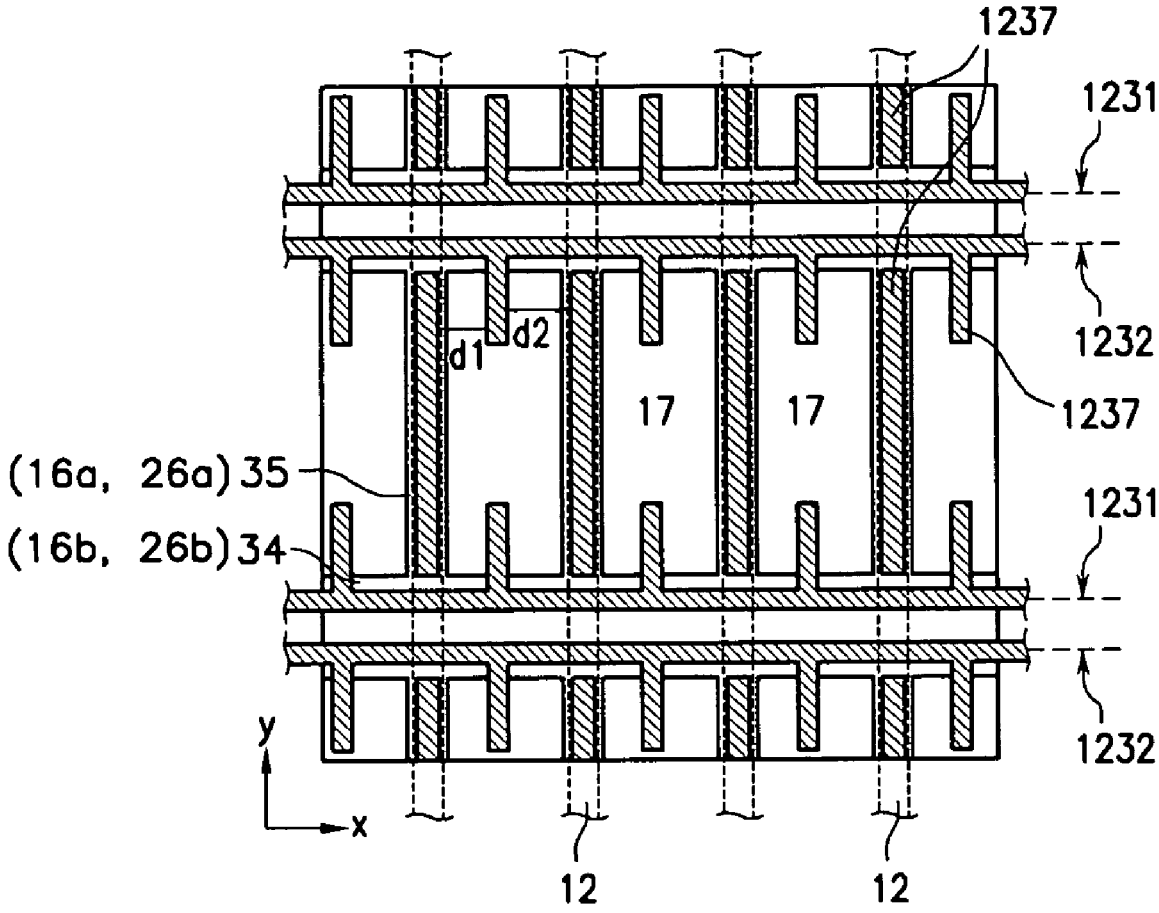
FIG. 24 is a plan view of the discharge cells and a black layer in the PDP of the twelfth embodiment of the present invention.

FIG. 24 is a plan view of discharge cells and a black layer in the PDP of the twelfth embodiment. The sustain electrodes 1231 and the scan electrodes 1232 are alternately located along a direction (y-axis direction) crossing the direction of the address electrodes 12. Each discharge cell 17, has the sustain electrodes 1231 on one side and the scan electrodes 1232 on the other side. The scan electrode 1232 of one discharge cell 17 and the sustain electrode 1231 of its adjacent discharge cell 17 are located together between the third and fourth barrier rib members 16*b*, 26*b* of these two adjacent discharge cells 17.

Figure 25:
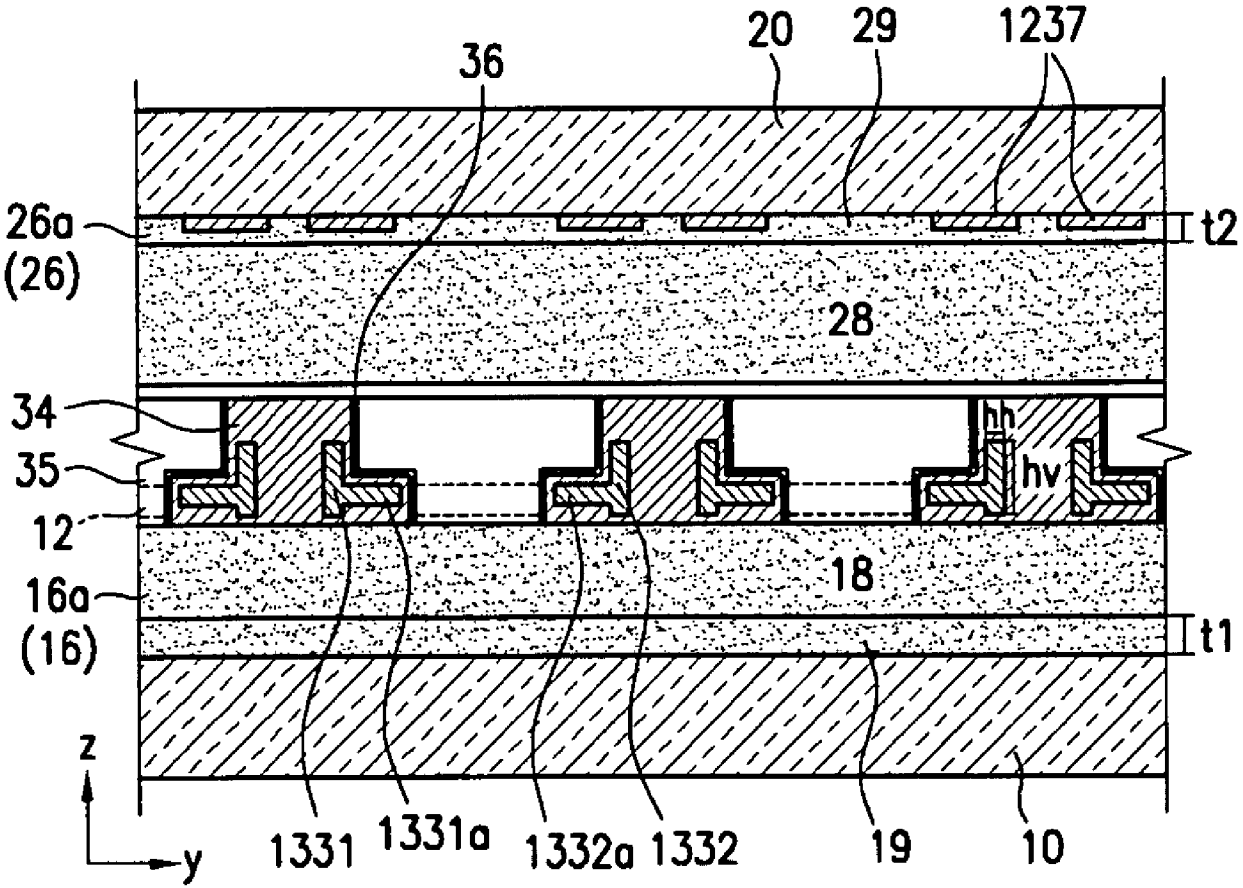
FIG. 25 is a cross-sectional view of a PDP according to a thirteenth embodiment of the present invention.
Figure 26:
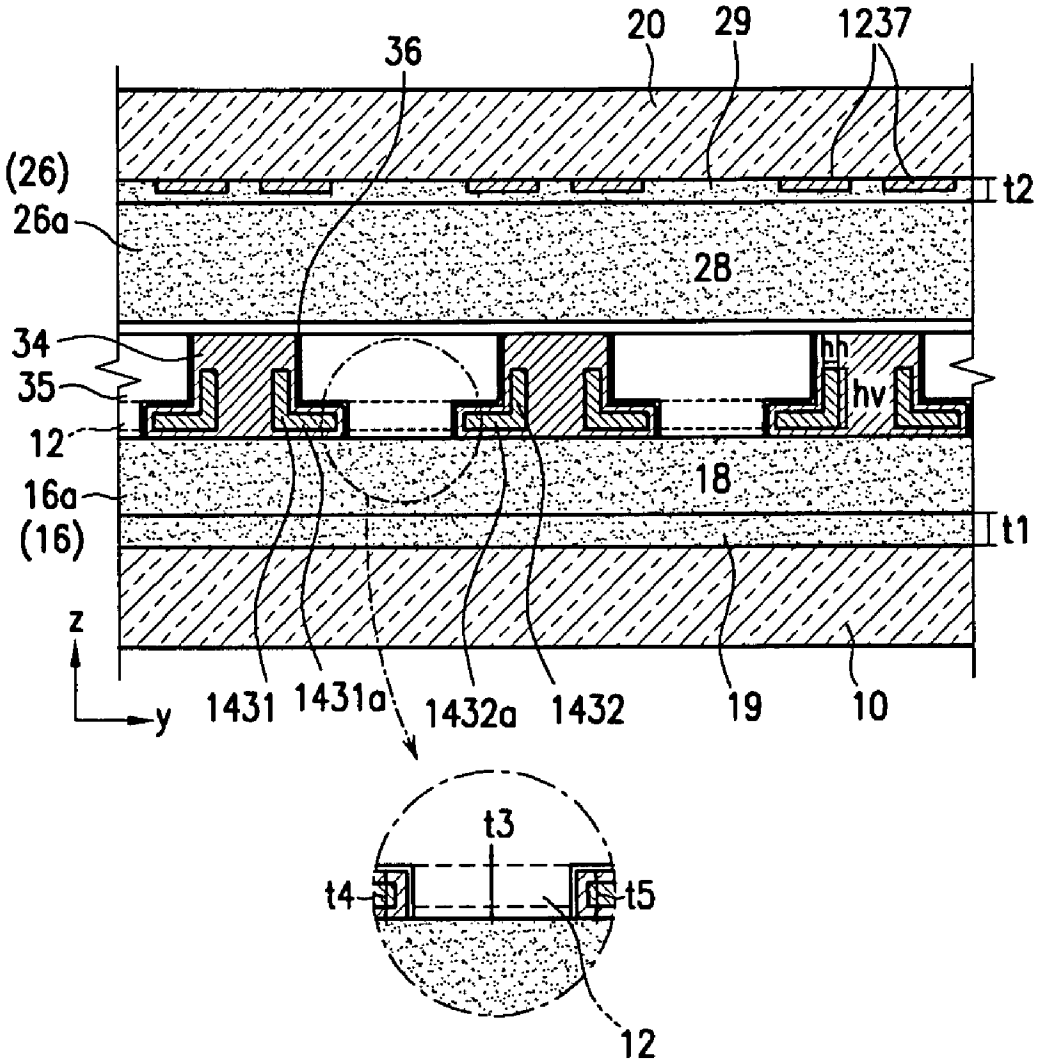
FIG. 26 is a cross-sectional view of a PDP according to a fourteenth embodiment of the present invention.

FIG. 25 is a cross-sectional view of a PDP according to a thirteenth embodiment of the present invention. FIG. 26 is a cross-sectional view of a PDP according to a fourteenth embodiment of the present invention.

In the thirteenth and fourteenth embodiments, the rear-plate barrier rib 16 has the first barrier rib members 16*a* that are formed in a direction parallel to the address electrodes 12 and the front-plate barrier rib 26 has the second barrier rib members 26*a* that are formed in a direction in parallel to the address electrodes 12. The rear-plate barrier rib 16 and the front-plate barrier rib 26, however, do not have third or fourth barrier rib members in a perpendicular direction to the address electrodes 12. Accordingly, the discharge cells 17 are continuously connected in stripes along the direction of the address electrodes 12 (y-axis direction).

Further, in the fourteenth embodiment of FIG. 26, the thickness t3 of the address electrode 12 in the direction perpendicular to the rear and front substrates 10, 20 (z-axis direction) is larger than the thickness t4 of a protruding portion 1431*a* of a sustain electrode 1431 and the thickness t5 of a protruding portion 1432*a* of a scan electrode 1432 in the same direction (z-axis direction). Accordingly, the opposing electrode discharge can be generated between the address electrode 12 and the protruding portion 1432*a* of the scan electrode 1432 over a wider area.

Figure 27:
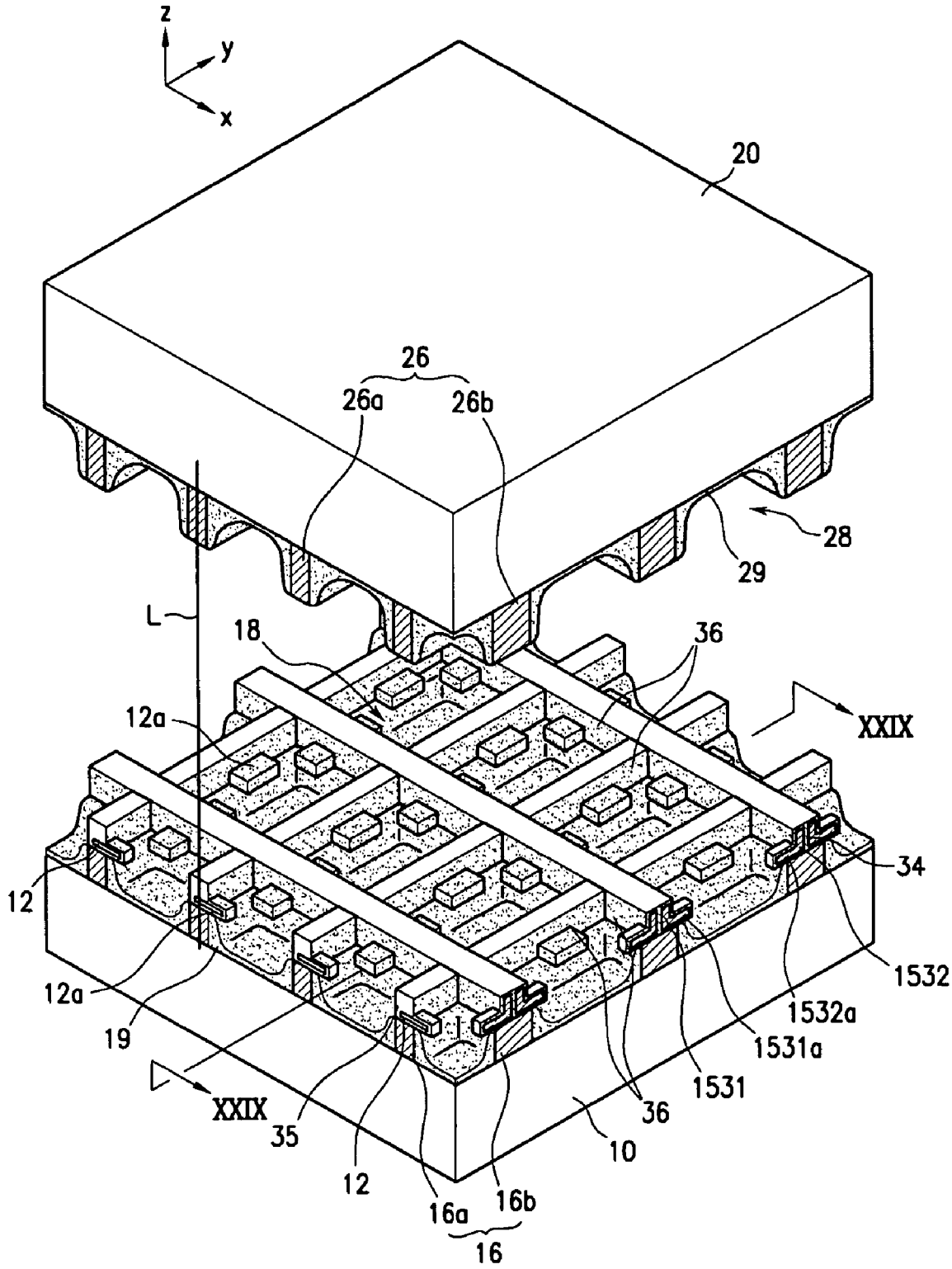
FIG. 27 is a partial exploded perspective view showing a PDP according to a fifteenth embodiment of the present invention.
Figure 28:
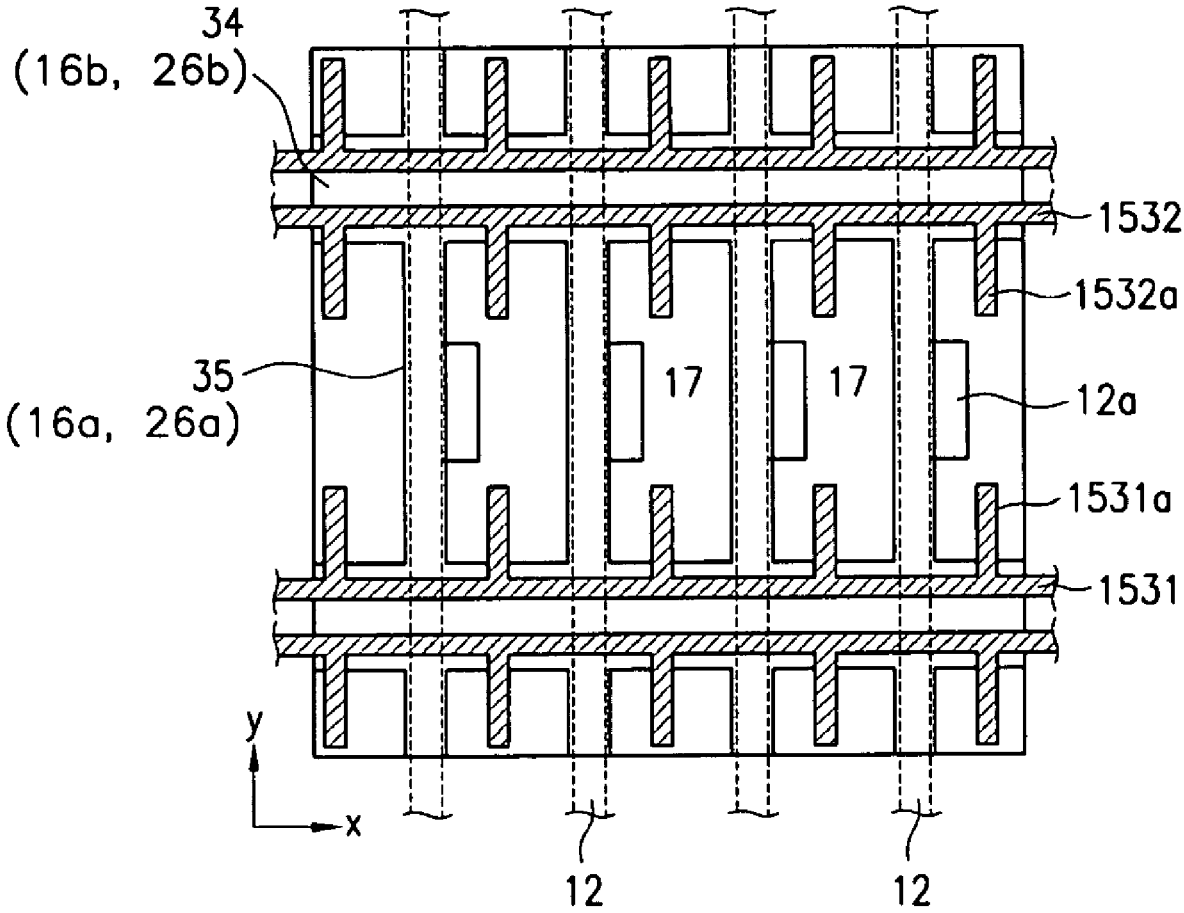
FIG. 28 is a plan view of electrodes and discharge cells in the PDP of the fifteenth embodiment of the present invention.
Figure 29:
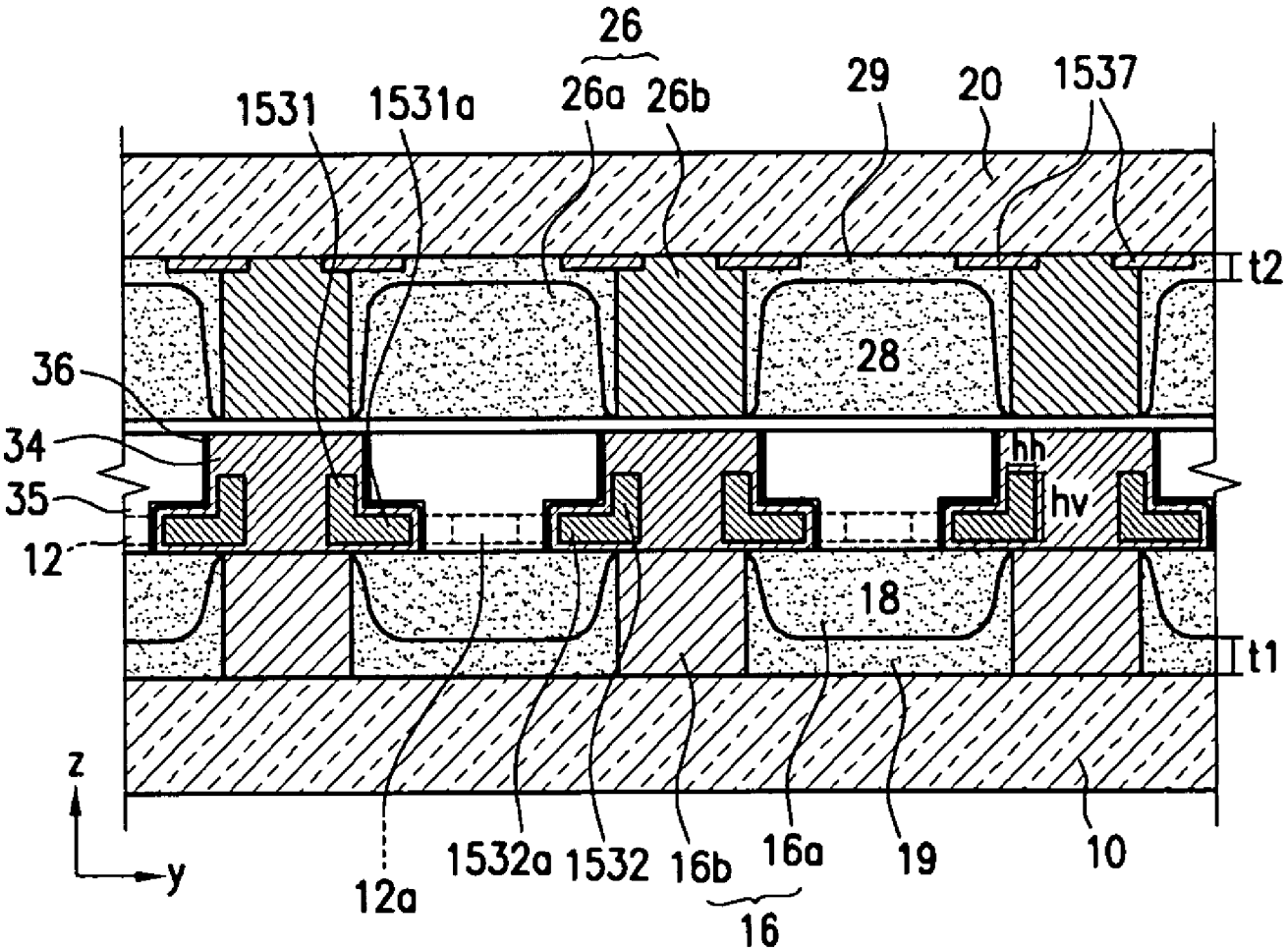
FIG. 29 is a cross-sectional view taken along the line XXIX-XXIX of FIG. 27.
Figure 30:
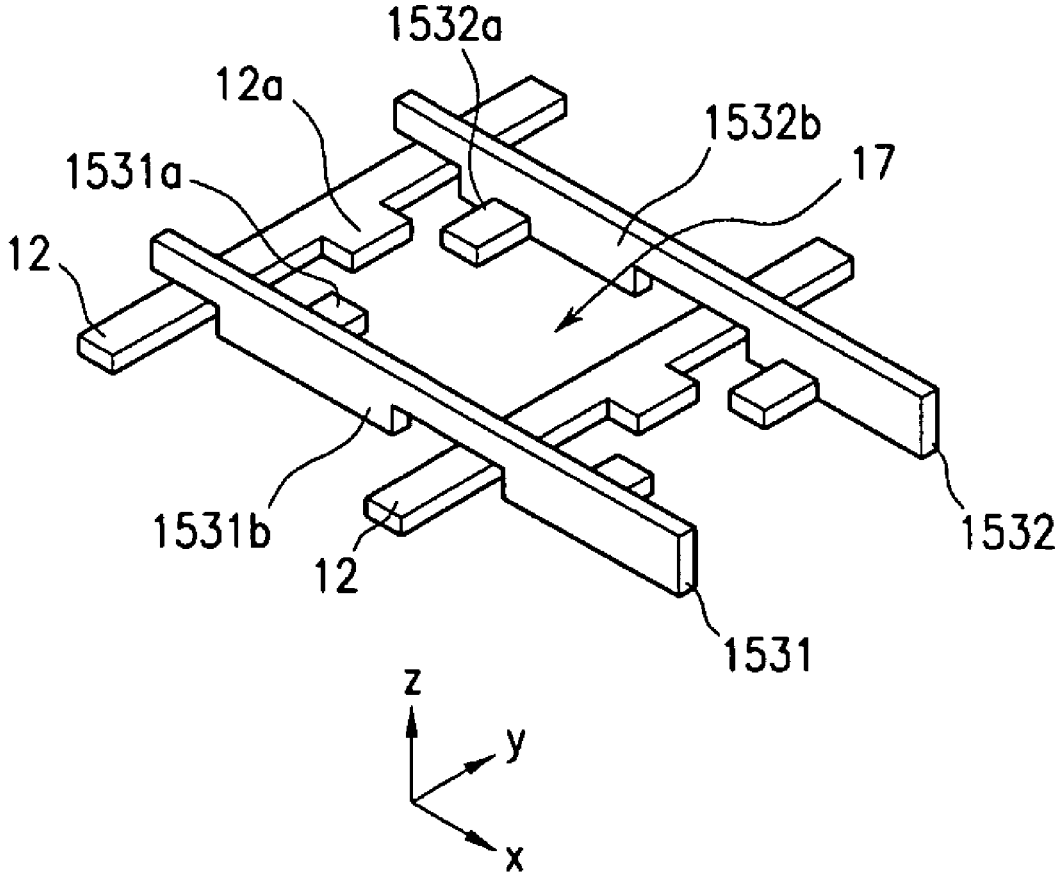
FIG. 30 is a perspective view of electrodes in the PDP of the fifteenth embodiment of the present invention.
Figure 31:
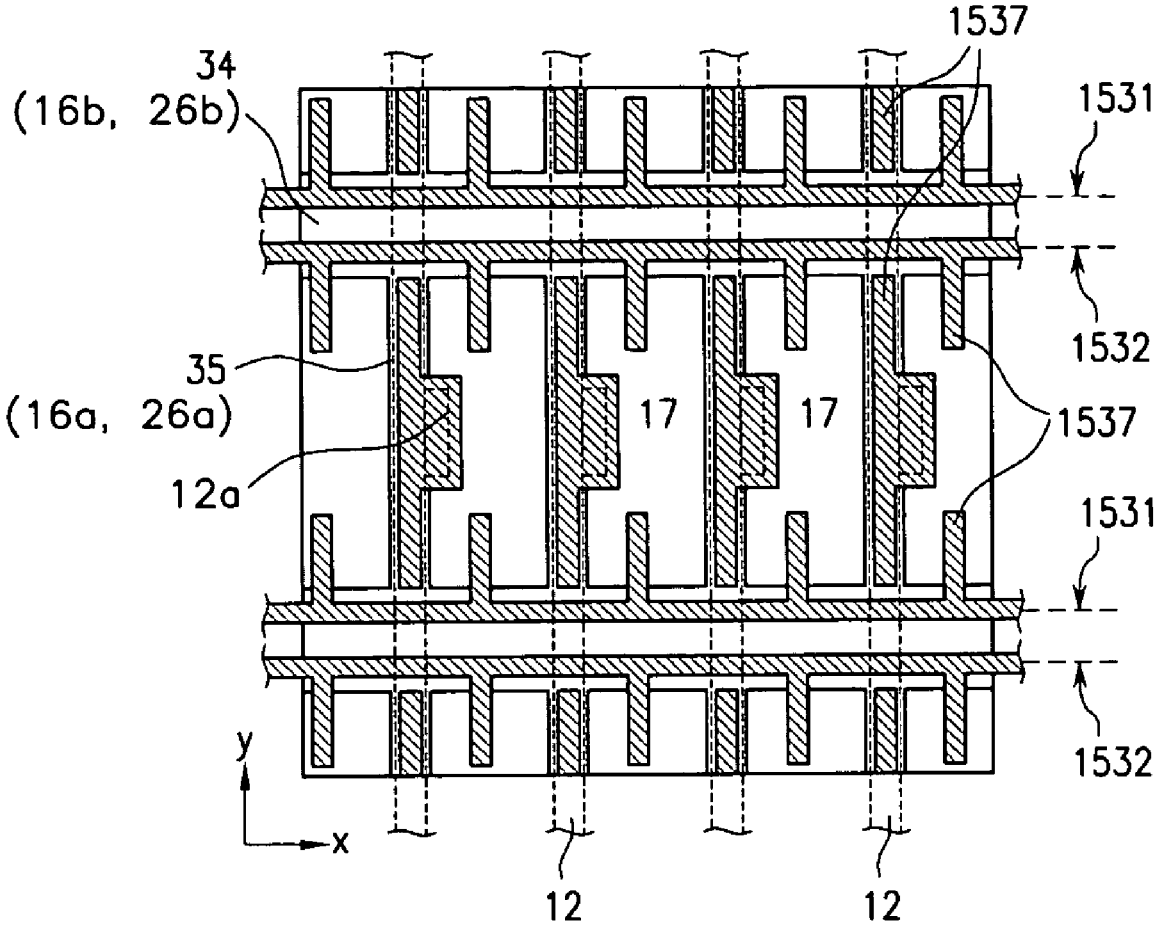
FIG. 31 is a plan view of the discharge cells and a black layer in the PDP of the fifteenth embodiment of the present invention.

FIG. 27 is a partial exploded perspective view of a PDP according to a fifteenth embodiment of the present invention. FIG. 28 is a plan view of electrodes and discharge cells in the PDP according to the fifteenth embodiment of the present invention. FIG. 29 is a cross-sectional view taken along the line XXIX-XXIX of FIG. 27. FIG. 30 is a perspective view of electrodes in the PDP of the fifteenth embodiment. FIG. 31 is a plan view of discharge cells and a black layer in the PDP according to the fifteenth embodiment. These drawings correspond to FIGS. 20, 21, 22, 23, and 24 of the twelfth embodiment.

In the fifteenth embodiment, the address electrode 12 has a protruding portion 12*a*. The protruding portion 12*a* protrudes toward a protruding portion 1531*a* of a sustain electrode 1531 and a protruding portion 1532*a* of a scan electrode 1532 and toward the center of the discharge cell 17. The protruding portion 12*a* of the address electrode 12 forms a shorter gap with the protruding portion 1532*a* of the scan electrode 1532, such that the address discharge can be generated with low voltage.

A black layer 1537 is formed on the front substrate 20, to have a shape corresponding to the address electrode 12, the sustain electrode 1531, and the scan electrode 1532, similar to the twelfth embodiment. The black layer 1537 is, in one embodiment, further formed corresponding to the protruding portion 12*a* of the address electrode 12 (see FIG. 31).

Figure 32:
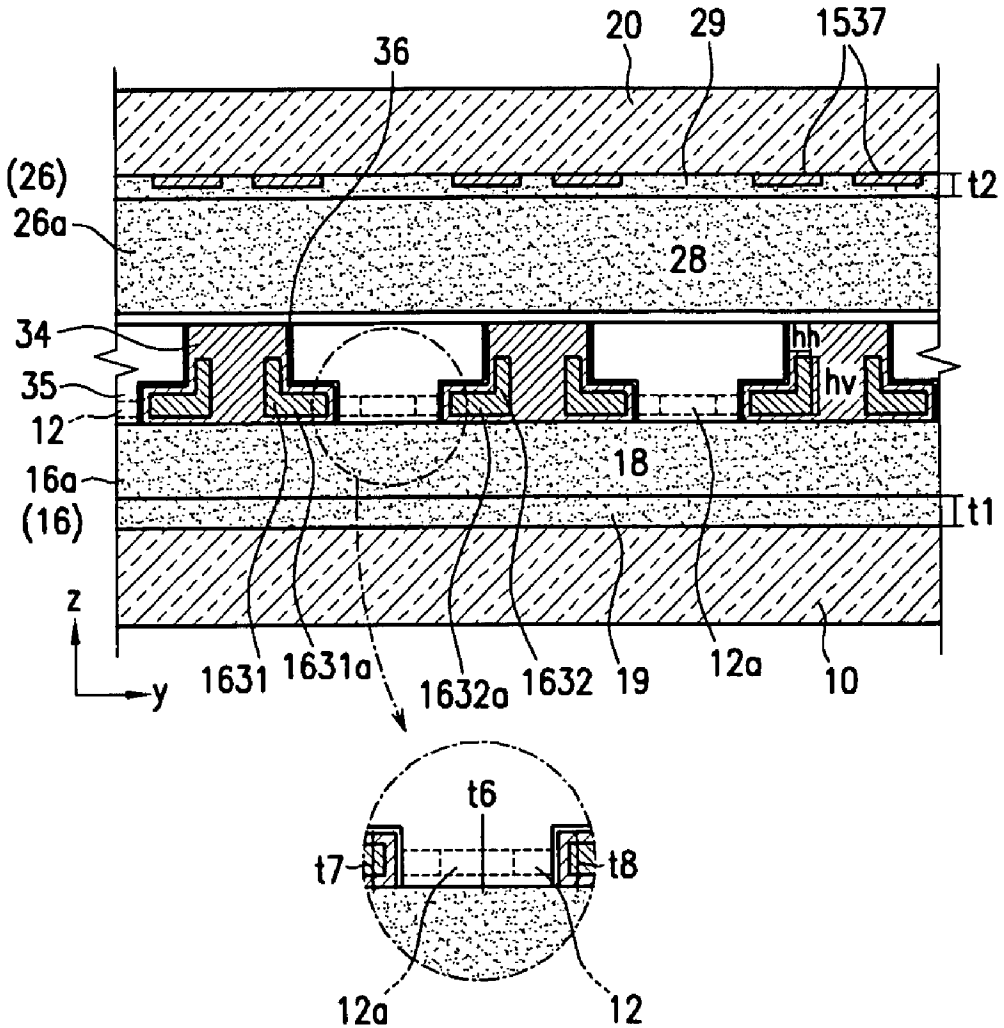
FIG. 32 is a cross-sectional view of a PDP according to a sixteenth embodiment of the present invention.

FIG. 32 is a cross-sectional view of a PDP according to a sixteenth embodiment of the present invention. In the sixteenth embodiment, the structures of the rear-plate barrier rib 16 and the front-plate barrier rib 26 of the thirteenth or fourteenth embodiments are applied to the configuration of the fifteenth embodiment.

In the sixteenth embodiment, the thickness of the address electrode 12 in the direction perpendicular to the substrates 10 and 20 (z-axis direction) is smaller than the thickness t7 of a protruding portion 1631*a* of a sustain electrode 1631 and the thickness t8 of a protruding portion 1632*a* of a scan electrode 1632 in that direction (z-axis direction). Accordingly, the opposing electrode discharge can be generated between the address electrode 12 and the protruding portion 1632*a* of the scan electrode 1632.

FIGS. 33, 34, 35, and 36 are plan views of electrodes and discharge cells in PDPs according to seventeenth to twentieth embodiments of the present invention, respectively. From these drawings, it can be seen that the address electrode 12 has the protruding portion 12*a*, and the protruding portion 12*a* of the address electrode 12, a protruding portion 1731*a* of a sustain electrode 1731, and a protruding portion 1732*a* of a scan electrode 1732 are formed to have various shapes and sizes (for example, see FIG. 33).

Figure 33:
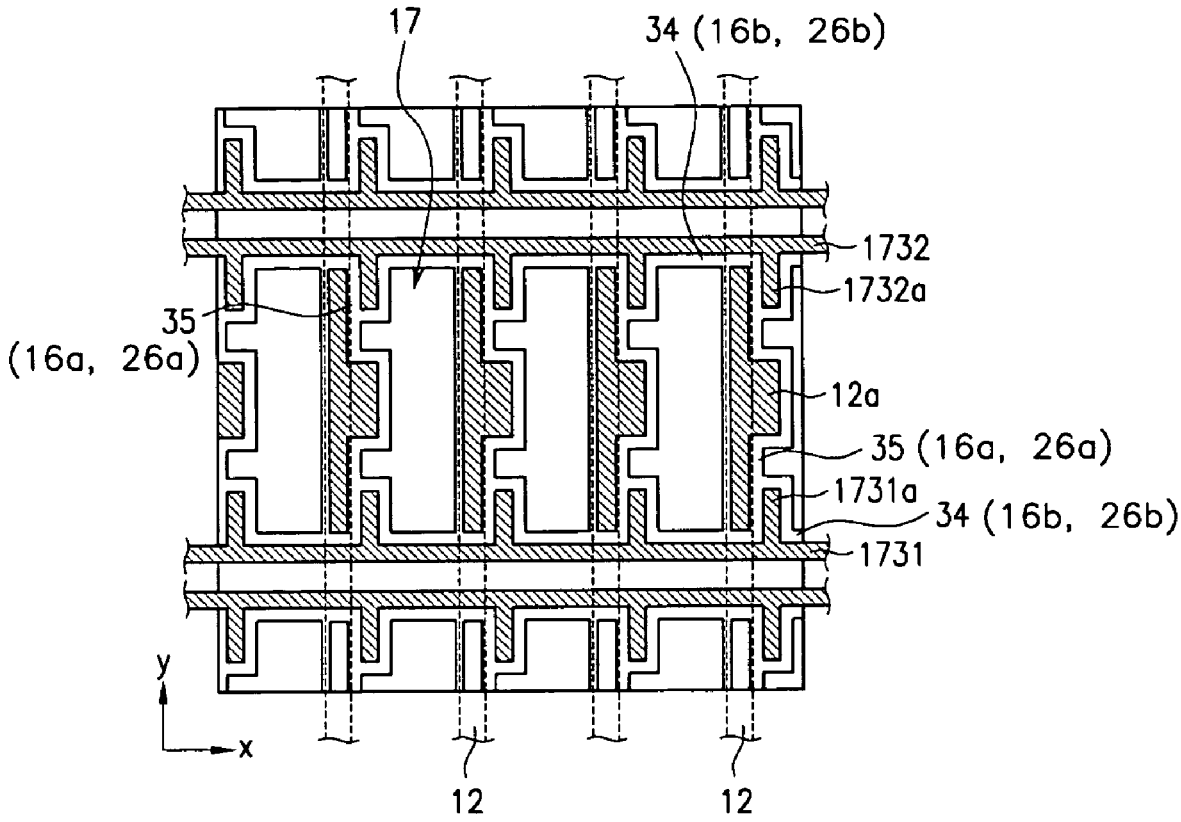
FIG. 33 is a plan view of electrodes and discharge cells in a PDP according to a seventeenth embodiment of the present invention.

In the embodiment of FIG. 33, the protruding portion 1731*a* of the sustain electrode 1731 and the protruding portion 1732*a* of the scan electrode 1732 are electrically isolated from the address electrode 12 by the dielectric layers 34, 35. Further, these protruding portions 1731*a*, 1732*a* are spaced apart from the protruding portion 12*a* of the address electrode 12 along the direction of the address electrodes 12 (y-axis direction). The protruding portion 1731*a* of the sustain electrode 1731 and the protruding portion 1732*a* of the scan electrode 1732 have the same length along the direction of the address electrodes 12 (y-axis direction).

Figure 34:
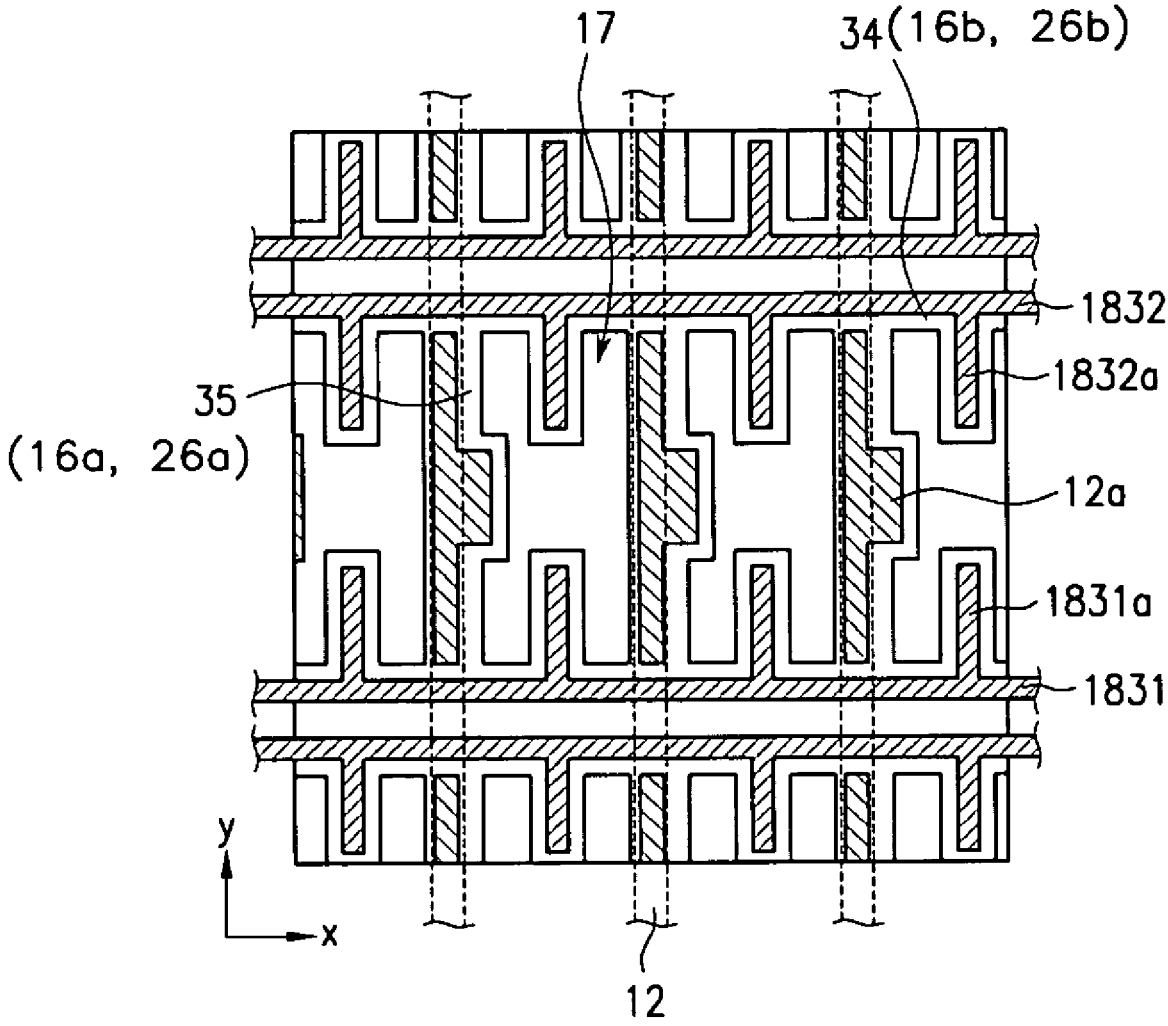
FIG. 34 is a plan view of electrodes and discharge cells in a PDP according to an eighteenth embodiment of the present invention.

In the eighteenth embodiment shown in FIG. 34, a protruding portion 1831*a* of a sustain electrode 1831 and a protruding portion 1832*a* of a scan electrode 1832 are spaced apart from the address electrode 12 and also spaced apart from the protruding portion 12*a* of the address electrode 12. The protruding portion 12*a* of the address electrode 12 is located between the protruding portion 1831*a* of the sustain electrode 1831 and the protruding portion 1832*a* of the scan electrode 1832.

Figure 35:
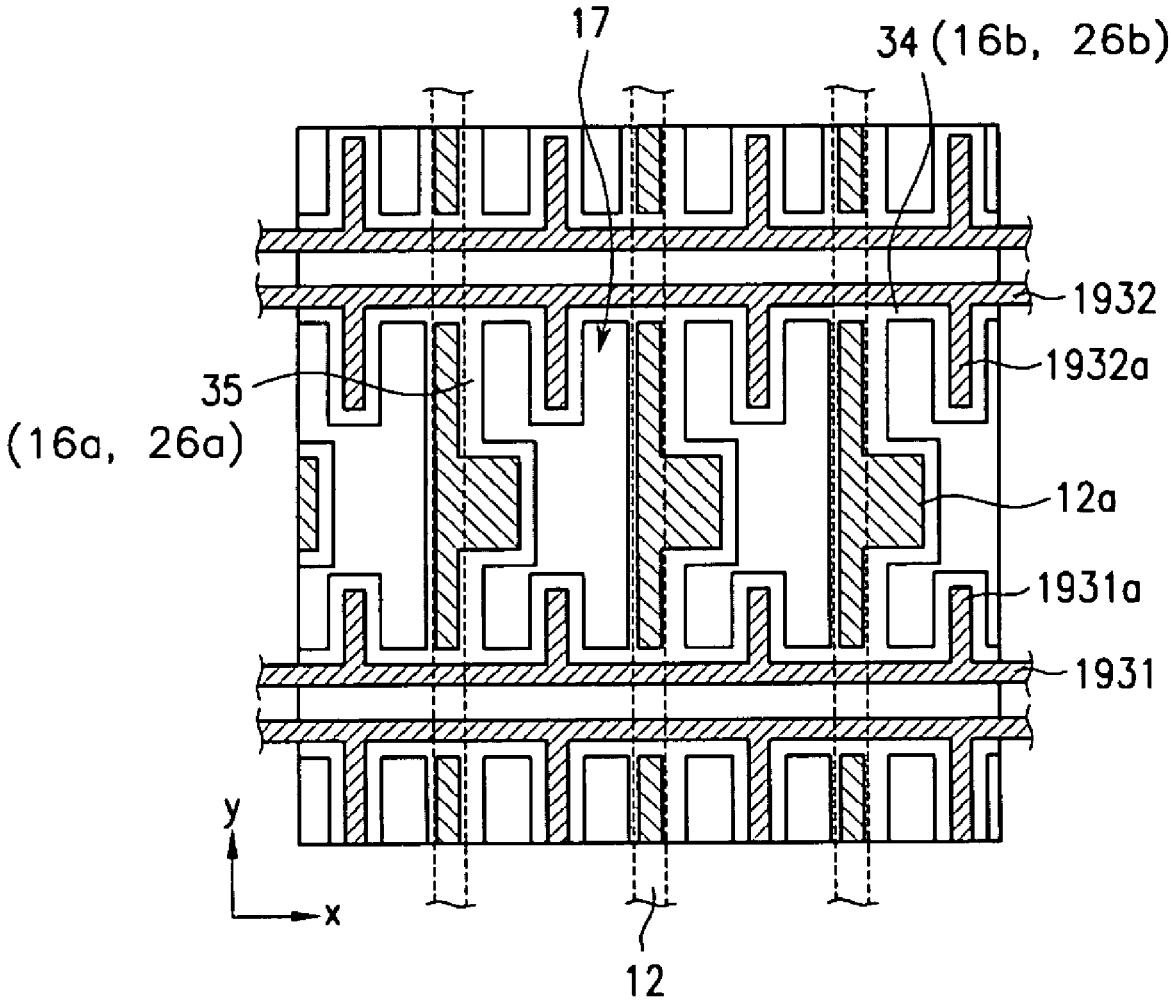
FIG. 35 is a plan view of electrodes and discharge cells in a PDP according to a nineteenth embodiment of the present invention.

In the nineteenth embodiment shown in FIG. 35, a protruding portion 1931*a* of a sustain electrode 1931 and a protruding portion 1932*a* of a scan electrode 1932, having different lengths, are spaced apart from the address electrode 12 and also spaced apart from the protruding portion 12*a* of the address electrode 12. The protruding portion 12*a* of the address electrode 12 is located between the protruding portion 1931*a* of the sustain electrode 1931 and the protruding portion 1932*a* of the scan electrode 1932 and is closer to the sustain electrode 1931. The length of the protruding portion 1931*a* of the sustain electrode 1931 is shorter than the length of the protruding portion 1932*a* of the scan electrode 1932.

Figure 36:
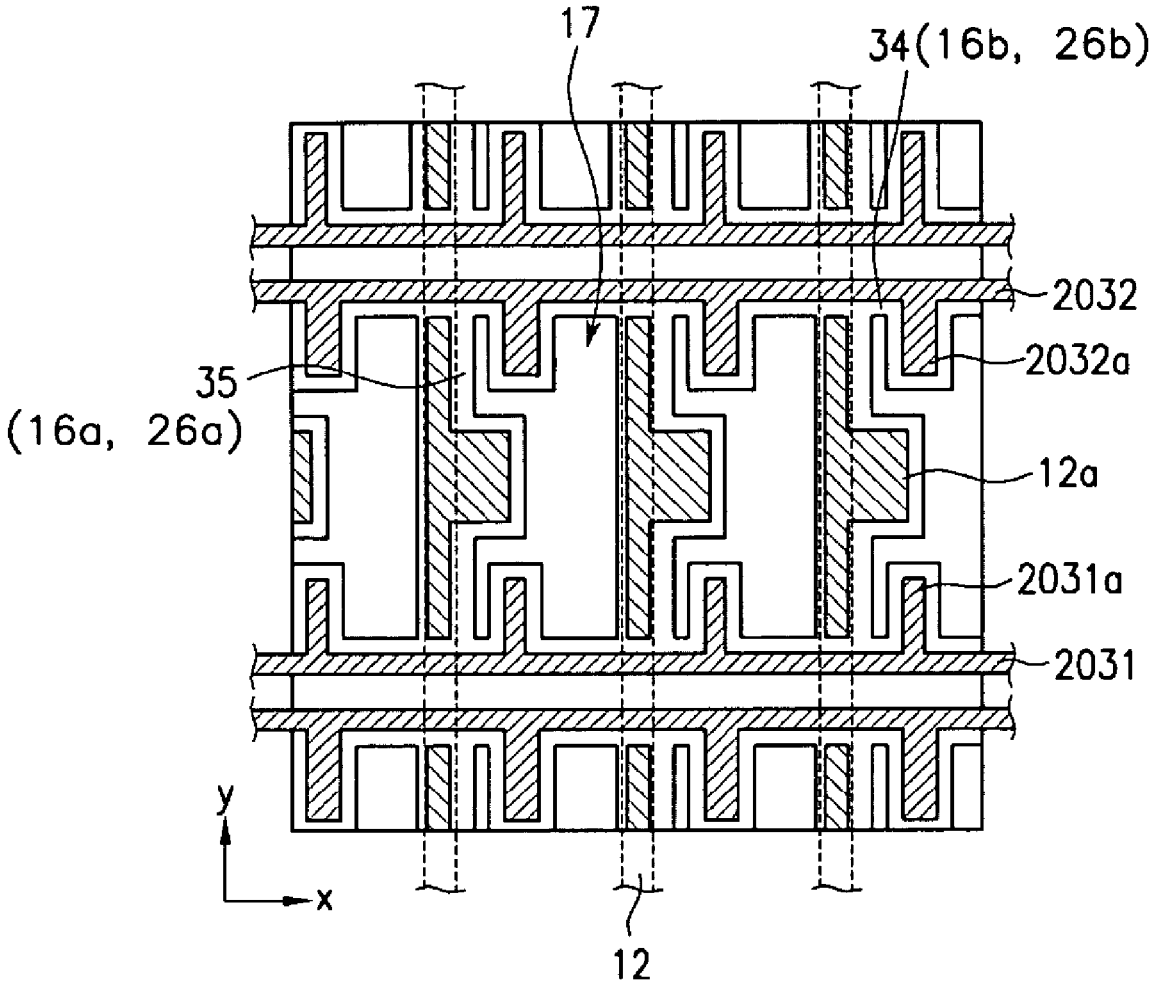
FIG. 36 is a plan view of electrodes and discharge cells in a PDP according to a twentieth embodiment of the present invention.

In the embodiment of FIG. 36, a protruding portion 2031*a* of a sustain electrode 2031 and a protruding portion 2032*a* of a scan electrode 2032 are spaced apart from the address electrode 12 and also spaced apart from the protruding portion 12*a* of the address electrode 12. The protruding portion 12*a* of the address electrode 12 is located between the protruding portion 2031*a* of the sustain electrode 2031 and the protruding portion 2032*a* of the scan electrode 2032. Further, the protruding portion 2032*a* of the scan electrode 2032 is wider than that of the protruding portion 2031*a* of the sustain electrode 2031.

As described above, according to the PDP of the present invention, the sustain electrodes and the scan electrodes are located according to the opposing electrode structure and the scan electrodes have the protruding portions. The protruding portions shorten the gap between the electrodes. As a result, at the beginning of the sustain discharge period, a discharge is induced across the short gap and requires only a reduced discharge firing voltage. After the discharge is generated, a long gap discharge is induced to enhance the luminescence efficiency.

The address electrodes may also have protruding portions. The protruding portions of the scan electrodes and the address electrodes are located according to the opposing electrode structure, and thus the address discharge voltage can be reduced. The sustain electrodes may also have protruding portion. When the sustain and the scan electrodes both have protruding portions, the sustain discharge voltage can be reduced.

According to the PDP of the present invention, the sustain, scan, and address electrodes are located according to the opposing electrode structure and the protruding portions of the scan electrodes have protrusions. Accordingly, the address discharge is induced across the short gap between the address electrodes and the protrusions of the scan electrodes, and the address discharge voltage can be further reduced.

Although exemplary embodiments of the present invention have been described in detail, it should be understood that many variations and/or modifications of the basic inventive concept taught will still fall within the spirit and scope of the present invention, as defined in the appended claims.

What is claimed is:

1. A plasma display panel comprising:

a first substrate;

a second substrate spaced apart from the first substrate;

a plurality of partitioned discharge cells between the first substrate and the second substrate, each of the partitioned discharge cells being configured by a pair of one first discharge space and one second discharge space opposite each other, the one first discharge space having a first phosphor layer and the one second discharge space having a second phosphor layer;

address electrodes extending along a first direction between the first substrate and the second substrate and parallel to them; and first electrodes and second electrodes extending along a second direction between and parallel to the first substrate and the second substrate, the second direction crossing the first direction, the first electrodes and the second electrodes being separated from the address electrodes;

wherein at least one of the first electrodes and the second electrodes includes:

an expansion portion expanding in a direction perpendicular to a surface of the first substrate corresponding to each discharge cell;

a narrow portion corresponding to a boundary between a pair of adjacent discharge cells; and a protruding portion protruding from the expansion portion toward respetive centers of the discharge cells.

2. The plasma display panel of claim 1, further comprising:

a first barrier rib layer on the first substrate forming the first discharge spaces; and a second barrier rib layer on the second substrate forming the second discharge spaces corresponding to the first discharge spaces.

3. The plasma display panel of claim 2, wherein the address electrodes, the first electrodes, and the second electrodes are between the first barrier rib layer and the second barrier rib layer.

4. The plasma display panel of claim 2, wherein the second discharge spaces have a larger volume than the first discharge spaces.

5. The plasma display panel of claim 2, wherein the first barrier rib layer includes first barrier rib members extending in the first direction, and wherein the second barrier rib layer includes third barrier rib members extending in the first direction.

6. The plasma display panel of claim 5, wherein the first barrier rib layer further includes second barrier rib members intersecting the first barrier rib members, and wherein the second barrier rib layer further includes fourth barrier rib members intersecting the third barrier rib members.

7. The plasma display panel of claim 5, wherein the address electrodes extend along the first barrier rib members between the first baffler rib members and the third barrier rib members.

8. The plasma display panel of claim 1, wherein each of the address electrodes is along a boundary between a pair of adjacent discharge cells.

9. The plasma display panel of claim 1, wherein the protruding portion protrudes in a polyhedron shape.

10. The plasma display panel of claim 1, wherein the first electrodes and the second electrodes are made of metal.

11. The plasma display panel of claim 1, wherein the first electrodes, the second electrodes, and the address electrodes have a dielectric layer on their outer surfaces.

12. The plasma display panel of claim 11, wherein the dielectric layer has a protective film on their outer surfaces.

13. The plasma display panel of claim 1, wherein the protruding portion of each of the second electrodes is closer to the address electrode on one side of the discharge cell than the address electrode on the other side.

14. The plasma display panel of claim 1, wherein at least a portion of each of the first electrodes and the second electrodes is on a same plane as the address electrodes.

15. A plasma display panel comprising:

a first substrate:

a second substrate spaced apart from the first substrate:

a plurality of partitioned discharge cells between the first substrate and the second substrate, each of the partitioned discharge cells being configured by a pair of one first discharge space and one second discharge space opposite each other, the one first discharge space having a first phosphor layer and the one second discharge space having a second phosphor layer;

address electrodes extending along a first direction between the first substrate and the second substrate and parallel to them;

first electrodes and second electrodes extending along a second direction between and parallel to the first substrate and the second substrate, the second direction crossing the first direction, the first electrodes and the second electrodes being separated from the address electrodes; and protruding portions on at least one of the first electrodes and the second electrodes, the protruding portions protruding toward respective centers of the discharge cells, wherein at least a portion of each of the first electrodes and the second electrodes is on a same plane as the address electrodes, and wherein a distance between the address electrode and a surface of the first substrate is the same as a distance between the first electrode and the surface of the first substrate and a distance between a corresponding one of the protruding portions of the second electrode and the surface of the first substrate.

16. A plasma display panel comprising:

a first substrate;

a second substrate spaced apart from the first substrate;

a plurality of partitioned discharge cells between the first substrate and the second substrate, each of the partitioned discharge cells being configured by a pair of one first discharge space and one second discharge space opposite each other, the one first discharge space having a first phosphor layer and the one second discharge space having a second phosphor layer;

address electrodes extending along a first direction between the first substrate and the second substrate and parallel to them;

first electrodes and second electrodes extending along a second direction between and parallel to the first substrate and the second substrate, the second direction crossing the first direction, the first electrodes and the second electrodes being separated from the address electrodes; and protruding portions on at least one of the first electrodes and the second electrodes, the protruding portions protruding toward centers of each discharge cell, wherein a thickness of the address electrode is larger than a thickness of a corresponding one of the protruding portions of the first electrode and a thickness of a corresponding one of the protruding portions of the second electrode, all thicknesses measured along a third direction perpendicular to a plane of the first substrate.

17. The plasma display panel of claim 1, wherein the first phosphor layer and the second phosphor layer are capable of generating visible light of a same color.

18. The plasma display panel of claim 17, wherein a thickness of the first phosphor layer is larger than a thickness of the second phosphor layer.

19. The plasma display panel of claim 1, further comprising:

black layers near the second substrate corresponding to planar patterns of the address electrodes, the first electrodes, and the second electrodes.

20. The plasma display panel of claim 1, wherein a sustain pulse is applied to the first electrode during a sustain discharge period, wherein the sustain pulse is applied to the second electrode during the sustain discharge period, and wherein a scan pulse is applied to the second electrode during an address period.

21. The plasma display panel of claim 20, wherein the first electrodes and the second electrodes are in pairs between adjacent discharge cells, and wherein the first electrodes and the second electrodes are in an alternating pattern.

22. The plasma display panel of claim 20, wherein the first electrodes are in pairs between adjacent one of the discharge cells, wherein the second electrodes are in pairs between adjacent one of the discharge cells, and the pairs of first electrodes and the pairs of the second electrodes are in an alternating pattern.

23. The plasma display panel of claim 1, wherein each of the address electrodes has a protruding portion protruding toward a center of a corresponding one of the discharge cells.

24. A plasma display panel comprising:

a first substrate;

a second substrate spaced apart from the first substrate;

a plurality of partitioned discharge cells between the first substrate and the second substrate, each of the partitioned discharge cells being configured by a pair of one first discharge space and one second discharge space opposite each other, the one first discharge space having a first phosphor layer and the one second discharge space having a second phosphor layer;

address electrodes extending along a first direction between the first substrate and the second substrate and parallel to them;

first electrodes and second electrodes extending along a second direction between and parallel to the first substrate and the second substrate, the second direction crossing the first direction, the first electrodes and the second electrodes being separated from the address electrodes; and protruding portions on at least one of the first electrodes and the second electrodes, the protruding portions protruding toward respective centers of the discharge cells, wherein each of the address electrodes has a protruding portion protruding toward a center of a corresponding one of the discharge cells, and wherein the protruding portion of each of the address electrodes is on a same plane as the protruding portion of each of the first electrodes or the protruding portion of each of the second electrodes.

25. The plasma display panel of claim 1, wherein a distance between each of the address electrodes and a surface of the first substrate is the same as a distance between the protruding portion of each of the first electrodes and the surface of the first substrate and a distance between the protruding portion of each of the second electrodes and the surface of the first substrate.

26. The plasma display panel of claim 1, wherein the protruding portion of each of the second electrodes has a protrusion protruding toward the address electrode on one side of a corresponding one of the discharge cells.

27. The plasma display panel of claim 26, wherein the protruding portion and the protrusion of each of the second electrodes are closer to the address electrode on one side of a corresponding one of the discharge cells.

28. The plasma display panel of claim 27, wherein a distance between the protrusion in the protruding portion of each of the second electrodes and the address electrode on one side of a corresponding one of the discharge cells is shorter than a distance between the protruding portion of each of the second electrodes and the address electrode on the other side of the corresponding one of the discharge cells.

29. A plasma display panel comprising:

a first substrate;

a second substrate spaced apart from the first substrate;

a plurality of partitioned discharge cells between the first substrate and the second substrate, each of the partitioned discharge cells being configured by a pair of one first discharge space and one second discharge space opposite each other, the one first discharge space having a first phosphor layer and the one second discharge space having a second phosphor layer;

address electrodes extending along a first direction between the first substrate and the second substrate and parallel to them;

first electrodes and second electrodes extending along a second direction between and parallel to the first substrate and the second substrate, the second direction crossing the first direction, the first electrodes and the second electrodes being separated from the address electrodes; and protruding portions on at least one of the first electrodes and the second electrodes, the protruding portions protruding toward respective centers of the discharge cells, wherein the protruding portion of each of the second electrodes has a protrusion protruding toward the address electrode on one side of a corresponding one of the discharge cells, and wherein black layers are near the second substrate corresponding to planar patterns of the address electrodes, the protruding portions of the first electrodes, the protrusions of the first electrodes, the protruding portions of the second electrodes and the protrusions of the second electrodes.

30. The plasma display panel of claim 20, wherein the first electrodes are in pairs between adjacent one of the discharge cells, each member of the pair of first electrodes supplying one of the adjacent discharge cells, wherein the second electrodes are a single second electrode between adjacent ones of the discharge cells, the single second electrode supplying both of the adjacent discharge cells, and wherein the pairs of first electrodes and the single second electrode are in an alternating pattern.

31. The plasma display panel of claim 26, wherein a dielectric layer is in the peripheries of the protruding portions and the protrusions, and wherein the dielectric layer has a uniform thickness on the protruding portions and the protrusions.

32. The plasma display panel of claim 11, wherein the dielectric layer is in the periphery of a protruding portion of each of the second electrodes, and wherein a thickness of the dielectric layer on a front end of the protruding portion is smaller than a thickness of the dielectric layer elsewhere.

33. The plasma display panel of claim 26, wherein the protrusion in the protruding portion has a wider area on a front end of the protruding portion, wherein a dielectric layer is in the periphery of the protruding portion of each of the second electrodes, and wherein a thickness of the dielectric layer on the protruding portion is equal to or less than a thickness of the dielectric layer on the protrusion.

34. A plasma display panel comprising:

a first substrate;

a second substrate spaced apart from the first substrate;

a plurality of partitioned discharge cells between the first substrate and the second substrate, each of the partitioned discharge cells being configured by a pair of one first discharge space and one second discharge space opposite each other, the one first discharge space having a first phosphor layer and the one second discharge space having a second phosphor layer;

address electrodes extending along a first direction between the first substrate and the second substrate and parallel to them;

first electrodes and second electrodes extending along a second direction between and parallel to the first substrate and the second substrate, the second direction crossing the first direction, the first electrodes and the second electrodes being separated from the address electrodes; and protruding portions on at least one of the first electrodes and the second electrodes, the protruding portions protruding toward centers of each discharge cell, wherein protrusion in the protruding portion has a wider area on a front end of the protruding portion, wherein a dielectric layer is in the periphery of the protruding portion of each of the second electrodes, wherein a thickness of the dielectric layer on the protruding portion is equal to or less than a thickness of the dielectric layer on the protrusion, and wherein the wider area of the protrusion is curved, a convex side of the curve facing the address electrodes.

35. A plasma display panel comprising:

a first substrate;

a second substrate spaced apart from the first substrate;

a plurality of partitioned discharge cells between the first substrate and the second substrate, the partitioned discharge cells having a first substrate discharge space on the first substrate and a second substrate discharge space on the second substrate, the first substrate discharge space having a first phosphor layer and the second substrate discharge space having a second phosphor layer;

address electrodes extending along a first direction between the first substrate and the second substrate and parallel to them;

first electrodes and second electrodes extending along a second direction between and parallel to the first substrate and the second substrate, the second direction crossing the first direction, the first electrodes and the second electrodes being separated from the address electrodes; and wherein the address electrodes, the first electrodes, and the second electrodes are between the first substrate discharge space and the second substrate discharge space, and wherein at least one of the first electrodes and the second electrodes includes:

an expansion portion expanding in a direction perpendicular to a surface of the first substrate corresponding to each of the discharge cells;

a narrow portion corresponding to a boundary between a pair of adjacent one of the discharge cells; and a protruding portion protruding from the expansion portion toward respective centers of the discharge cells.

* * * * *